US005813818A

United States Patent [19]

McNeilus et al.

[11] Patent Number: 5,813,818

[45] Date of Patent: Sep. 29, 1998

[54] MULTI-COMPARTMENT SIDE BUCKET REFUSE COLLECTION SYSTEM

[75] Inventors: Garwin McNeilus, Dodge Center, Minn.; Ronald E. Christenson, Parsons, Tenn.; Wilbur R. Harris, Rochester, Minn.

[73] Assignee: McNeilus Truck and Manufacturing, Inc., Dodge Center, Minn.

[21] Appl. No.: 963,541

[22] Filed: Nov. 3, 1997

Related U.S. Application Data

[63] Continuation of Ser. No. 596,731, Feb. 5, 1996, abandoned, which is a continuation-in-part of Ser. No. 508,384, Jul. 31, 1995, abandoned.

[51] Int. Cl.[6] ..... B65F 3/02

[52] U.S. Cl. ..... 414/407; 414/409; 414/512; 414/517; 414/525.2

[58] Field of Search ..... 414/409, 487, 414/512, 517, 521, 407, 525.2, 408

[56] References Cited

U.S. PATENT DOCUMENTS

| | | | |
|---|---|---|---|
| 3,910,434 | 10/1975 | Ebeling et al. . | |
| 4,090,626 | 5/1978 | Ebeling et al. . | |
| 4,425,070 | 1/1984 | Howells et al. | 414/498 |
| 4,427,333 | 1/1984 | Ebeling | 414/409 |
| 4,597,710 | 7/1986 | Kovats | 414/409 |
| 4,840,531 | 6/1989 | Dinneen | 414/409 |
| 4,915,570 | 4/1990 | Ruth et al. | 414/487 X |
| 4,978,271 | 12/1990 | Seader | 414/487 |
| 5,007,786 | 4/1991 | Bingman | 414/409 |
| 5,035,563 | 7/1991 | Mezey | 414/409 |
| 5,035,564 | 7/1991 | Matsumoto | 414/409 |
| 5,074,737 | 12/1991 | Pellegrini et al. | 414/512 X |
| 5,092,731 | 3/1992 | Jones et al. | 414/409 X |
| 5,122,025 | 6/1992 | Glomski | 414/486 |
| 5,288,196 | 2/1994 | Horning et al. | 414/407 |
| 5,316,430 | 5/1994 | Horning et al. | 414/407 |
| 5,344,273 | 9/1994 | Rodleir | 414/517 X |
| 5,427,496 | 6/1995 | Ratledge, Jr. et al. | 414/525.2 |
| 5,584,642 | 12/1996 | Huntoon | 414/517 X |

FOREIGN PATENT DOCUMENTS

| | | | |
|---|---|---|---|
| 960020 | 4/1978 | Belgium . | |
| 0 405 345 A1 | 1/1991 | European Pat. Off. . | |
| 3537546 | 4/1987 | Germany | 414/512 |
| 2191461 | 12/1987 | United Kingdom | 414/409 |
| WO 94/21540 | 9/1994 | WIPO . | |

*Primary Examiner*—David A. Bucci
*Attorney, Agent, or Firm*—Haugen and Nikolai, P.A.

[57] ABSTRACT

Side-loading refuse vehicles are disclosed including an offset or recessed hopper section having at least one recessed side which accommodates a loading bin or bucket which is moveable between a lowered position and a raised dumping position. Followers attached to the bucket on each end are engaged in candy cane shaped guide channels situated at the front and rear of the hopper. The guide channels are angled away from the base of the hopper and curved into the top of the hopper to guide the bucket in an angled and arcuate path over the sidewall of the hopper which is built to accommodate the bucket. In some embodiments, a bin handler is built into the bucket or an automated arm is provided for dumping refuse cans or containers directly into the hopper. The refuse vehicles may have side-loading buckets on one or both sides of the vehicle and the vehicles may be single or multiple compartment vehicles. In another aspect of the invention, the vehicles include a removable body which is separable from the hopper section.

13 Claims, 37 Drawing Sheets

MULTI-COMPARTMENT SIDE BUCKET REFUSE COLLECTION SYSTEM

CROSS-REFERENCE TO RELATED APPLICATION

This is a continuation of application Ser. No. 08/596,731, filed on Feb. 5, 1996, now abandoned which is a continuation-in-part of application Ser. No. 08/508,384, filed Jul. 31, 1995, now abandoned.

BACKGROUND OF THE INVENTION

1. Field of the Invention

The present invention relates generally to vehicles for collecting, packing, hauling, and unloading refuse materials which may include recyclable materials. More particularly, the invention is directed to refuse collection systems which incorporate integral side-loading lift and dump bucket systems which cooperate with corresponding offset or recessed receiving hoppers having packing devices to load refuse materials into truck bodies. The truck body and loading system including the hopper may be divided into a plurality of separate dedicated compartments to segregate materials during loading and maintain separation after compaction. The side-loading system includes one or more single or multi-compartment manually-loaded buckets and may also be provided with an automated extensible arm system for addressing and tipping other curbside containers.

2. Related Art

The business of collecting, hauling, and disposing of waste materials is rapidly becoming increasingly complex. The materials of collection, in addition to normal refuse disposable at landfills, may further contain a variety of types of materials destined for recycle. It is preferable that materials collected for recycle be at least separated from other refuse if not further broken down into individual recycle species at the point of collection. Of course, generally the complete breakdown into separate species is not practical, but it is desirable that at least highly compactable materials (for example, aluminum, plastic, and paper) be separated from glass at this juncture.

Furthermore, the types of containers in which materials are placed at the points of collection are many and varied. This, of course, has led to the development of a variety of dedicated accessing, lifting and dumping devices to be carried by collection vehicles.

It is known to provide a dedicated rail or track or similar guide or mounting system on the side of a refuse vehicle in combination with a dedicated container which can be filled in a lowered position and thereafter lifted and dumped using a dedicated lift and dump mechanism and operating along the guide system. Side-loading mechanisms of this type are described in U.S. Pat. Nos. 3,910,434 and 4,090,626 to Ebeling et al.; 4,427,333 to Ebeling; and 4,597,710 to Kovats. A vertical rail assembly having a bin-gripping carriage apparatus for engaging, lifting and dumping a refuse container is the subject of U.S. Pat. No. 5,007,786 to Bingman.

Multi-compartment systems which include dedicated multi-compartment collection receptacles which operate using guided mechanized lift and dump systems to lift and empty them into corresponding multi-compartment hoppers and haulers have also been described. One such system that includes a vertically moving external lifting and dumping trough having a series of compartments which correspond to internal truck body divisions is shown in Dinneen (U.S. Pat. No. 4,840,531). The internal compartments are discharged by tilting the truck body relative to the chassis. In Seader (U.S. Pat. No. 4,978,271), a pair of pivoting buckets on each side empty into larger containers mounted on the chassis of the truck forward of a rear-loading refuse body. Mezey (U.S. Pat. No. 5,035,563) discloses multi-compartment container/hopper systems for front and side-loading trucks.

A further side-loading multi-compartment system is depicted by Ratledge, Jr., et al. in U.S. Pat. No. 5,427,496. Other divided side bucket-loaded multi-compartment refuse truck bodies are illustrated and described by Horning et al. in U.S. Pat. Nos. 5,288,196 and 5,316,430 and by Glomski in U.S. Pat. No. 5,122,025. Buckets may be provided on both sides of these devices and may be recessed. Howells et al. (U.S. Pat. No. 4,425,070) discloses a single sided divided bucket which loads compartments forward of a rear-loading refuse body mounted on an elongated frame.

While each of these systems has certain desirable attributes, all of these devices have shortcomings or limitations overcome by one or more aspects of the embodiments of the present invention, which contemplates an improved lift and dump guide systems for side bucket loaders in combination with offset or recessed hoppers in singular multi-compartment versions. Additionally, boom-mounted container emptying devices may be combined with the bucket system. The truck bodies may be permanently mounted or removable/detachable units. These ends are achieved with a general simplification of the prior mechanical complexity of such systems and introduce improvements which facilitate efficient operation.

Accordingly, it is a primary object of the present invention to provide an improved side-loading refuse vehicle.

Another object of the invention is to provide an improved multi-compartment side-loading refuse vehicle.

Yet another object of the invention is to provide an improved bucket lifting and dumping mechanism for a single or multi-compartment side-loading refuse vehicle.

Still another object of the invention is to provide improved side-loading refuse vehicles having bucket lifting and dumping mechanisms which reduce spillage commonly associated with bucket lift and dump mechanisms.

Yet still another object of the invention is to provide an improved side-loading refuse vehicle having single or multi-compartment mechanized lift and dump buckets on both sides of a receiving hopper.

A further object of the invention is provide an improved side-loading refuse vehicle which has a refuse hopper recessed to correspond with the longitudinal chassis support beams of the vehicle.

A still further object of the invention is to provide an improved side-loading refuse vehicle in which an extensible boom container lift and dump mechanism is combined with one or more side-loading bucket lift and dump systems in a single or multi-compartment system.

A yet still further object of the invention is to provide a multi-compartment refuse hopper which avoids the build-up of refuse materials behind associated compartmentalized compaction devices.

SUMMARY OF THE INVENTION

The present invention provides improved side-loading refuse collecting vehicles of the class having a generally vertically operating, manually loaded bucket system in conjunction with a complimentary compensating offset receiving and charging hopper. The charging hopper is associated with a truck body having forward and aft ends and mounted on a truck frame extending longitudinally along the truck body, the truck body enclosing a material receiving volume. The truck support frame or chassis typically is constructed using a pair of spaced cross based main longitudinal channels or stringer members and the offset receiving hopper of the invention may be recessed as far as the adjacent chassis channel member to accommodate a wider charging bucket.

The bucket system includes an improved lift and dump mechanism and an elongate guide channel system which includes the pair of initially outward extending and finally arcuate guide paths which accommodate with offset follower members attached to each side of the bucket which cooperate to maintain an upright bucket posture in the loading position and provide additional inversion angle in the arc when the bucket is fully raised in the discharge position. The guides are preferably recessed channels and in the general shape of candy canes. The buckets are designed for manual loading. In conjunction with the outward directed channel guide systems, the hopper is preferably flared at the top to reduce the possibility of material spillage or loss in dumping. In addition, the buckets of the system may themselves be provided with can handling devices. In addition, each of the several embodiments of the refuse truck of the invention may be used in combination with a removable material receiving truck body. These, of course, may take any of several forms.

The refuse collection system may further include an automated extensible boom arm with an associated container lift and dump mechanism which may include an operable grabber system in addition to the bucket system. The extensible arm may include a system that adjusts the position of the grabber mechanism along the arm to allow dumping at diverse fore and aft locations in the charging hopper. Adjustable grabbers are typically associated with multi-compartment systems.

The refuse collection vehicles may take the form of any of a number of embodiments. These include one having a single side bucket of one compartment associated with a truck body having a single material receiving volume in which a single material receiving volume and packer are provided in the receiving hopper. A single divided bucket may be located on one side of the vehicle and used to charge a front to rear split two-compartment receiving hopper which, in turn, charges a truck body having a split material receiving volume using dual packing devices which may operate together. Of course, a system employing either a single bin or split bin bucket loading system may also be combined with an automated extensible boom arm lift and dump mechanism for automated dumping of refuse cans. The split is typically fore and aft with the forward bucket and hopper compartment associated with a lower truck body material receiving volume and the aft or rear bucket and hopper compartment associated with the upper truck body material receiving volume. In this regard, the grabber positioning mechanism is used in conjunction with the extensible boom arm lift and dump mechanism to allow cans to be loaded into either forward or aft compartments of the charging hopper.

In another embodiment, a three compartment longitudinally split bucket loading system is used in conjunction with a three compartment loading or charging hopper in the top to bottom three compartment material receiving volume. The three compartment charging system is configured so that the upper storage compartment of the storage body is charged by the rearmost receiving hopper compartment; the middle storage compartment charged by the middle receiving hopper, and the lower storage compartment is charged by the forward receiving section. Each hopper compartment is provided with a packing ram system. Compaction may be accomplished by a linkage arrangement in which the two upper compacting ram systems for the two upper compartments are operated from a single powered lower compacting system by a sequential linkage arrangement which may be force modulated. In the alternative, separate, independently operated ram systems may be provided to serve each compartment of the charging hopper.

A plurality of both single and multiple compartmented manually loaded buckets can be used alone or in conjunction with an automated fixed or adjustable position extensible boom arm and grabber systems. Single or multi-compartment buckets may be symmetrically or asymmetrically placed on both sides of the charging hopper with commensurate recesses being provided in the hopper to accommodate each bucket.

In addition, means are provided to prevent accumulation of refuse material trapped behind packing devices. In this regard, a hinged door may be provided in the front wall associated with the upper compartment behind the compactor which allows the material accumulated behind the packer to escape into the lower compartment upon retraction of the packer.

Thus, the present invention represents a variety of improvements in a class of side-loading refuse vehicles which can take the form in any of a great variety of embodiments. The detailed embodiments are taken as representative or exemplary of those in which the improvements of the invention may be incorporated and are not presented as being limiting in any manner.

DETAILED DESCRIPTION

Figure 1:
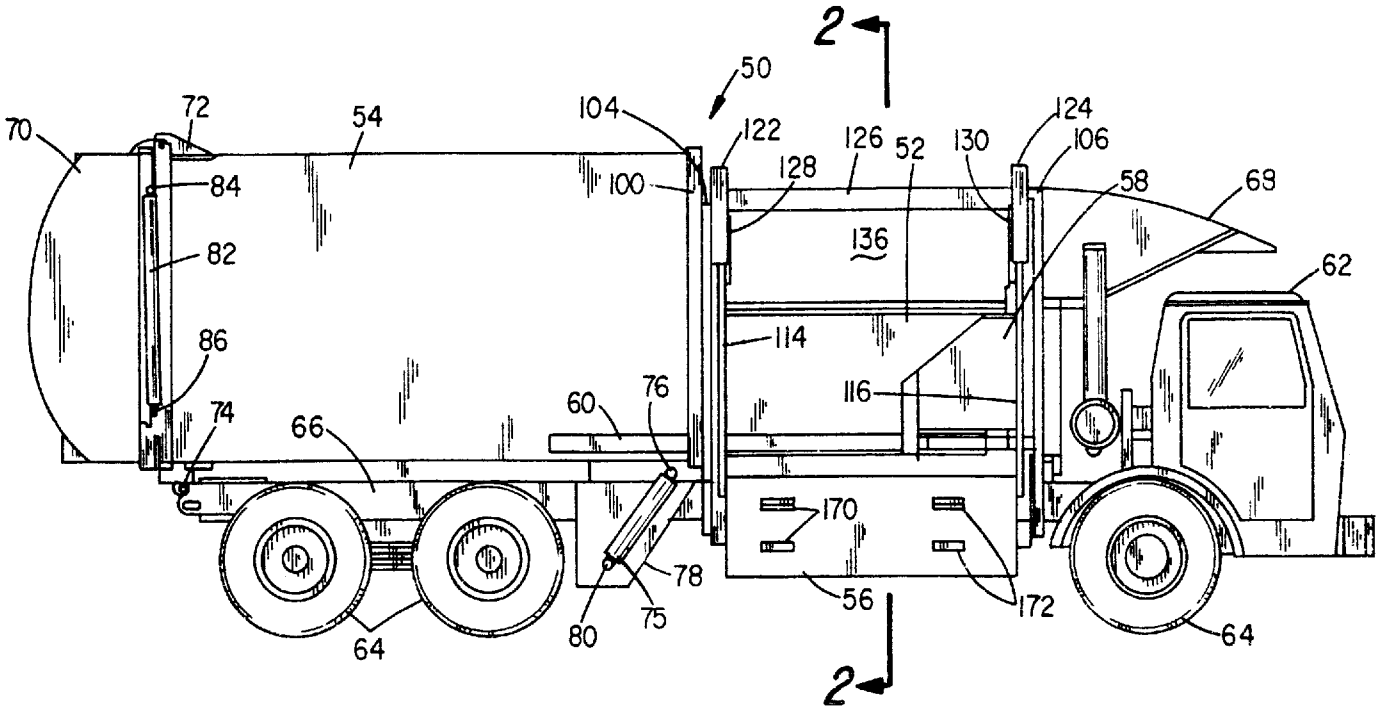
FIG. 1 is a side elevational view of a single compartment side-loading refuse vehicle in accordance with the invention.
Figure 2:
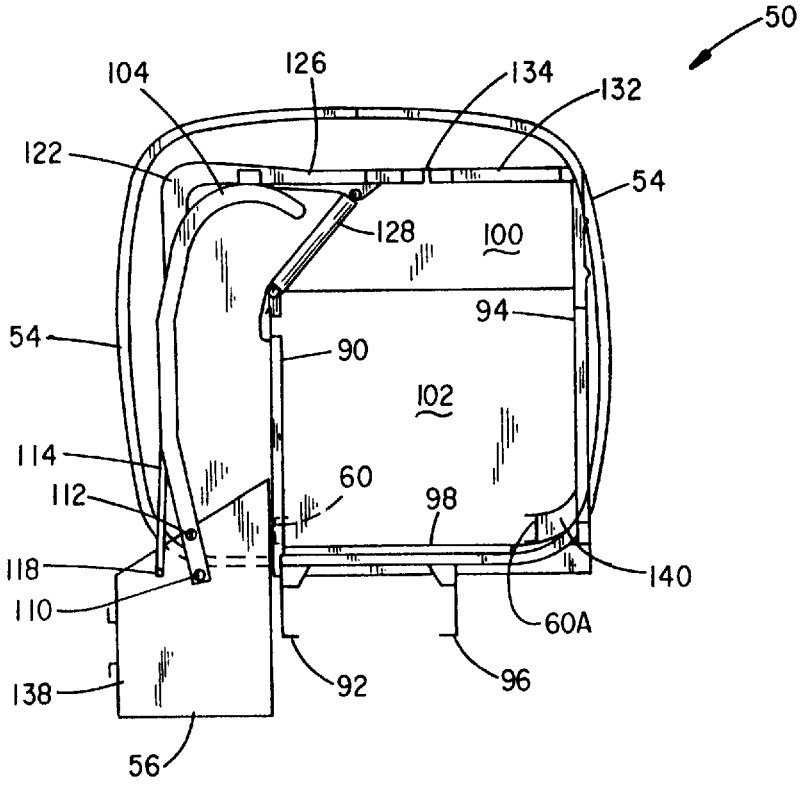
FIG. 2 is a sectional view taken substantially along line 2—2 of FIG. 1 depicting the bucket in the lowered or loading position.

The offset side-loading hopper system of the present invention is generally applicable to single and multiple compartmented collection vehicles and is characterized by an offset hopper which is recessed on at least one side to accommodate a so called "candy cane" guide channel bucket lift and dump loading system wherein the loading bucket or bin is raised along the guide channel or rail to be dumped into the hopper. The candy cane channel is angled in at the bottom to return the loading bucket close to the hopper in the lowered or loading position such that the bucket does not protrude substantially beyond the width of the storage body of the collection vehicle. The hopper is recessed or offset inwardly and may be offset to correspond with the chassis frame of the collection vehicle. The hopper is offset on at least one side to accommodate a single bucket and may be offset on both sides to accommodate loading a bucket on each side of the collection vehicle. The number and location of material compartments in the loading bucket and hopper are variable and are generally commensurate with the number of compartments in the storage body of the collection vehicle. In another aspect of the invention, the collection vehicle includes means for lifting and dumping a refuse can into the hopper using the candy cane-shaped guide channel and bucket system together with an extensible boom arm and grabber.

In connection with the drawings of the present invention, several representative embodiments will now be described in detail. FIGS. 1–8 depict a single compartment side-loading refuse collection vehicle 50 including a single compartment refuse hopper 52 attached to a single compartment storage body 54. The refuse hopper 52 is offset to one side of the refuse vehicle 50 (FIGS. 2 and 3) and a loading bin or bucket 56 is designed to be carried next to the refuse hopper 52 on the indented side of the refuse vehicle 50. As described below, the loading bin 56 is raised and dumped into the refuse hopper 52. The refuse packer 58 is slidably engaged and operated on packer rails one of which is shown at 60 situated in the refuse hopper 52 and extending into the storage body 54. The packer 58 is operated to move refuse from the refuse hopper 52 and pack it into the storage volume of storage body 54.

The collection vehicle 50 includes the conventional cab 62 and wheels 64 connected to and supporting a chassis or frame 66 which carries the storage body 54 and refuse hopper 52. A cab protector or deflector 68 is attached to the hopper section 52 at the front of the vehicle 50 and a tailgate 70 is pivotally attached to the top of the storage body 54 by vertically displaceable hinges at 72 at the rear of the vehicle 50. Tailgate lift cylinders, one of which is shown at 82, are pivotally attached to the tailgate 70 at 84 and to the storage body 54 at 86. The storage body 54 is pivotally attached to the frame 66 at 74 and a pair of side lift cylinders as at 75 are pivotally attached to the storage body 54 as at 76 and to frame extension 78 at 80. To unload the vehicle 50, the tailgate lift cylinders 82 are extended to vertically displace and pivot or swing the tailgate 70 to an open position, and lift cylinders 75 are extended to lift and pivot the storage body 54 and hopper 52 about the pivot 74, in a well-known manner.

As shown in FIGS. 1–4, the bucket is carried in a lowered position next to refuse hopper side wall 90 for loading and raised to a dump position above the refuse hopper side wall 90 (FIG. 3) for discharging. The refuse hopper 52 is offset to one side of the chassis frame 66 or recessed such that refuse hopper wall 90 is essentially aligned with a first chassis longitudinal frame member 92 and the opposing refuse hopper wall 94 is essentially full width beyond the second chassis frame member 96. Thus, the hopper floor 98 extends essentially from first chassis frame member 92 over the second chassis frame member 96 and beyond to one side of the refuse collection vehicle 50. The storage body 54 is separated from the refuse hopper 52 by front wall 100 which includes an opening 102 (FIGS. 2 and 3) through which refuse is forced by packer 58.

The lifting bucket 56 is slidably engaged on each end to candy cane shaped guide channels 104 and 106 which are attached to the front wall 100 of the storage body 54 and an extension of the front wall 108 (FIG. 4) of the hopper 52, respectively. Rollers or followers 110 and 112, which may be nylon rollers, are rotatably attached to the sides of the bucket 56 and slidably inserted in the candy cane channels 104 and 106 on each side of the loading bin 56. Lift rods 114 and 116 are pivotally attached at each end of the loading bucket 56 at 118 and 120 and are pivotally attached to lift arms 122 and 124 which in turn are securely attached to the refuse hopper lid or top door 126. Actuators 128 and 130 (hydraulic cylinders), are pivotally attached to the refuse hopper sidewall 90 and the refuse hopper lid 126 which in turn is pivotally attached to the refuse hopper structure at 132 and hinged along 134. A heavy screen 136 is attached to the hopper door 126 between the lifting arms 122 and 124 and extends from the top door 126 to the hopper sidewall 90 in the lowered position.

Figure 3:
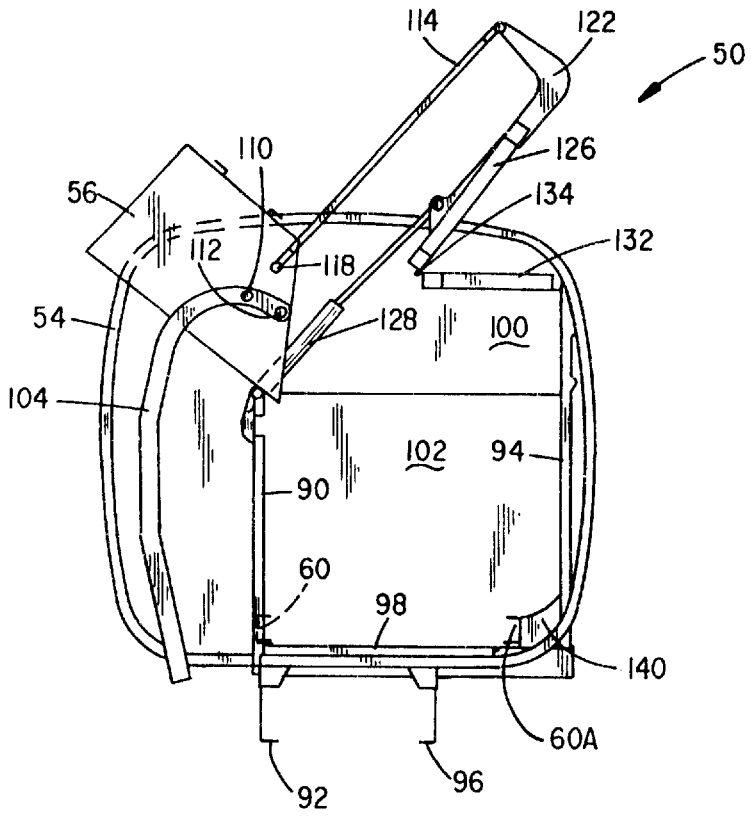
FIG. 3 is similar to FIG. 2 illustrating the bucket in the fully raised or discharging position.
Figure 4:
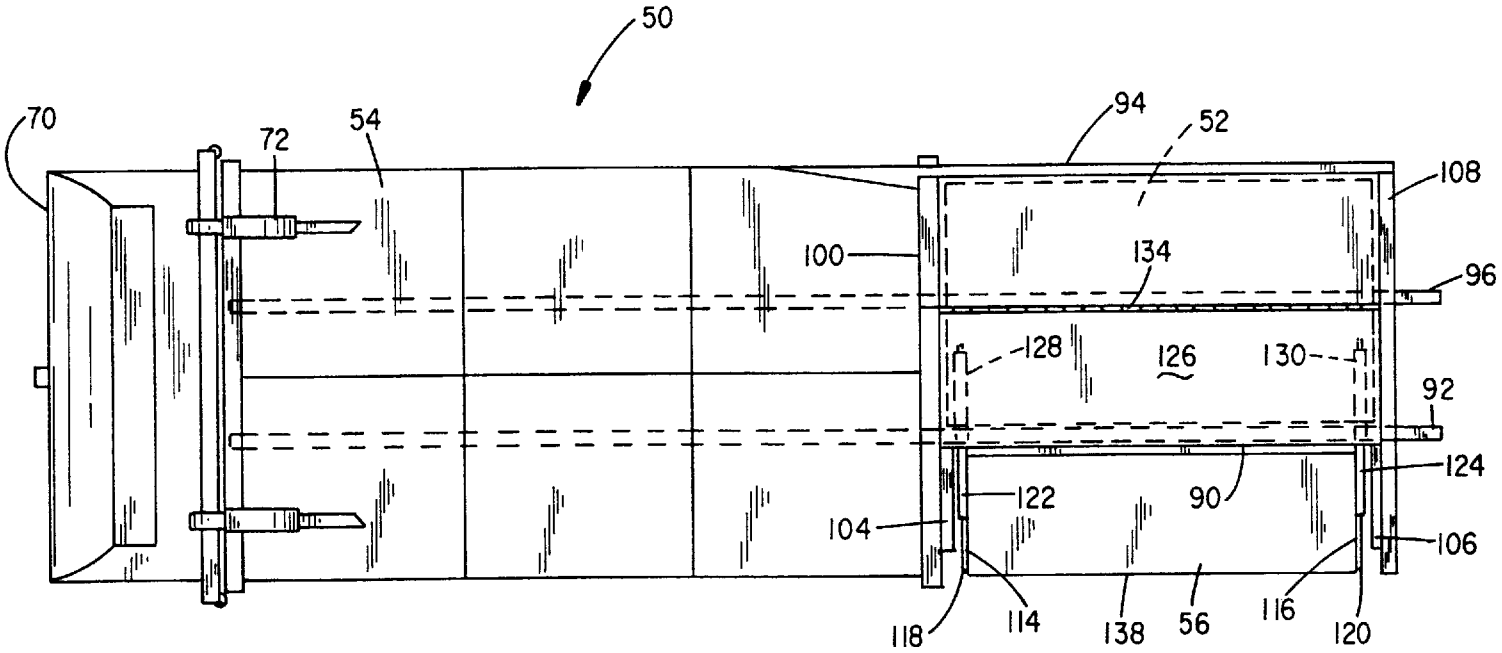
FIG. 4 is a top view of the truck body and charging hopper of FIG. 1.

In operation, container 56 is raised to the dump position (FIG. 3) by extending cylinders 128 and 130 to raise the hopper door 126 and attached lift arms 122 and 124 to an open position. Lift rods 114 and 116 raise bucket 56 to the dump position (FIG. 3). Rollers 110 and 112 follow in the candy cane channels 104 and 106 to guide bucket 56 in an angled and arcuate path to the dump position. The candy cane channels 104 and 106 are initially angled outward from the bottom away from the refuse hopper sidewall 90. Toward the top, the candy canes 104 and 106 angle in toward the hopper 52 and are curved at the top in an arcuate path to tip the loading bin 56 into the dump position. The rollers or followers 110 and 112 are rotatably attached to the front and rear side of the loading bin 56. The lower roller 110 is positioned slightly closer to the back wall of the loading bin 56 as compared to the upper roller 112 so that, in the lowered position (FIG. 2), the loading bin 56 is postured in essentially a vertical position and when the rollers 110 and 112 reach the vertical portion of the candy canes 104 and 106 the bucket 56 tips slightly toward the refuse hopper 52. This helps maintain refuse in the loading bin 56 as it is raised to the dump position. The rollers 110 and 112 are spaced apart such that they traverse the arcuate path of the candy canes 104 and 106 at the top. With the lower roller 110 closer to the back wall, the bucket 56 is tilted to a greater degree for dumping refuse into the hopper 52 as compared to if the rollers 110 and 112 were evenly spaced from the back wall of the loading bin 56. In the lowered position, the inwardly angled portion of the candy canes 104 and 106 guides the bucket 56 snugly close to the refuse hopper sidewall 90 such that the front wall 138 of the loading bin 56 is essentially in line with the storage body 54.

Figure 5:
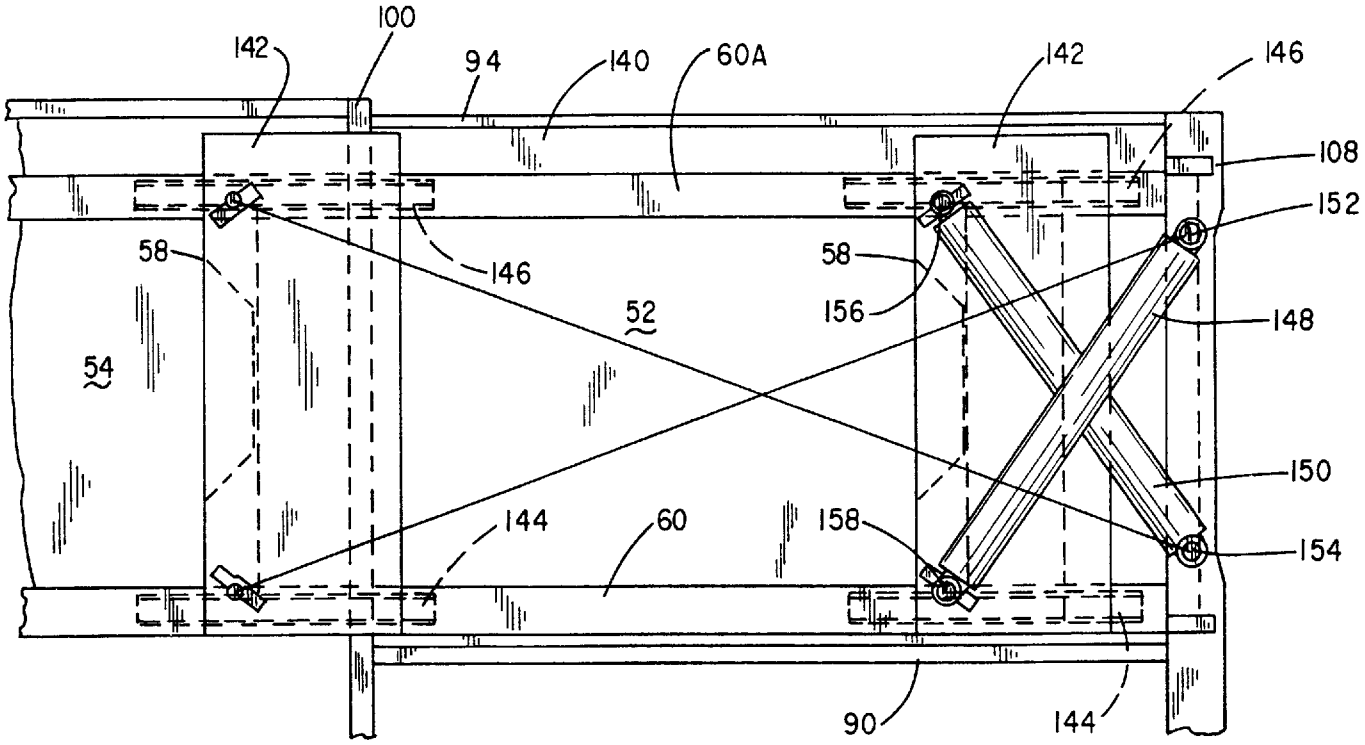
FIG. 5 is a plan view of the packing mechanism of FIG. 1 depicting the packer in both forward and aft locations.

The reciprocating packer 58 is slidably engaged on guide rails or channels 60 and 60A which are positioned along hopper sidewall 90 and hopper sidewall 94 (FIGS. 2 and 3), respectively. As shown, guide rail 60A is spaced from sidewall 94 and a curved extension 140 is attached between the hopper sidewall 94 and guide rail 60A to shield the edge of the hopper 52. As shown in FIG. 5, the packer 58 includes a packer extension 142 which sweeps beyond packer rail 60A. Guide channel slide or wear bars 144 and 146 are securely attached to the packer 58 in indented or recessed portions of the packer 58 such that slide bar 144 is slidably engaged in guide rail or channel 60 and slide bar 146 is slidably engaged in guide rail or channel 60A. Packer extension 142 is curved on its lower portion and straight on its upper portion to fit along the curved sidewall extension 140 and the hopper sidewall 94. Thus, this offset packer assembly 58 including the packer extension 142 fits between and closely follows hopper sidewalls 90 and 94.

Figure 6:
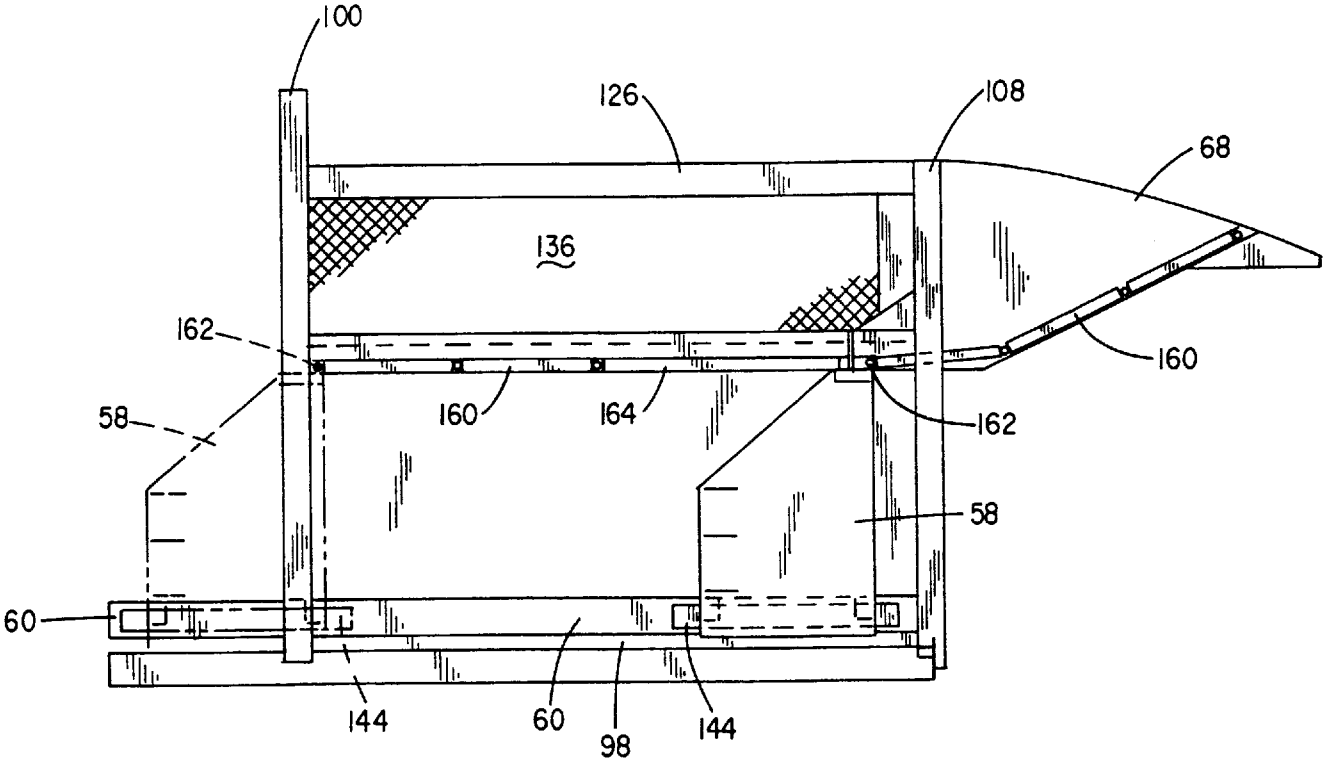
FIG. 6 is an enlarged fragmentary side view of the hopper and packing mechanism of FIG. 1 with the packing mechanism shown in a fore and aft position.

As shown in FIGS. 5 and 6, the packer 58 is moved between a forward position and a packing position by two vertically stacked fluid operated actuators or hydraulic cylinders 148 and 150 which are pivotally attached to the hopper front wall 108 at 152 and 154 and the inside of the packer 58 at 156 and 158. The packer 58 is slid through the hopper 52 and possibly partially past the storage body front wall 100 and into the storage body 54 to move refuse from the hopper 52 and pack it into the storage body 54 by extending hydraulic cylinders 148 and 150. The guide rails 60 and 60A may extend into the storage body 54 and the hydraulic cylinders 148 and 150 are extended to move the packer 58 such that the slide bars 144 and 146 remain slidably engaged in the guide rails 60 and 60A. The packer 58 is provided with a linked follower panel 160 which is pivotally connected to the packer 58 at hinge 162. The follower panel 160 is made up of a plurality of possibly three links which are hinged to one another and which extend from hopper sidewall 90 to hopper sidewall 94. The follower panel 160 is slidably connected by pins or rollers attached to the follower panel 160 and engaged in follower panel guide rails or channels 164 which are attached to hopper sidewalls 90 and 94. As the packer 58 is moved from the forward position to the packing position, the follower panel 160 slides along the guide channels 164 to protect the hopper floor 98 behind the packer 58. This prevents material from falling behind the packer 58.

Figure 7:
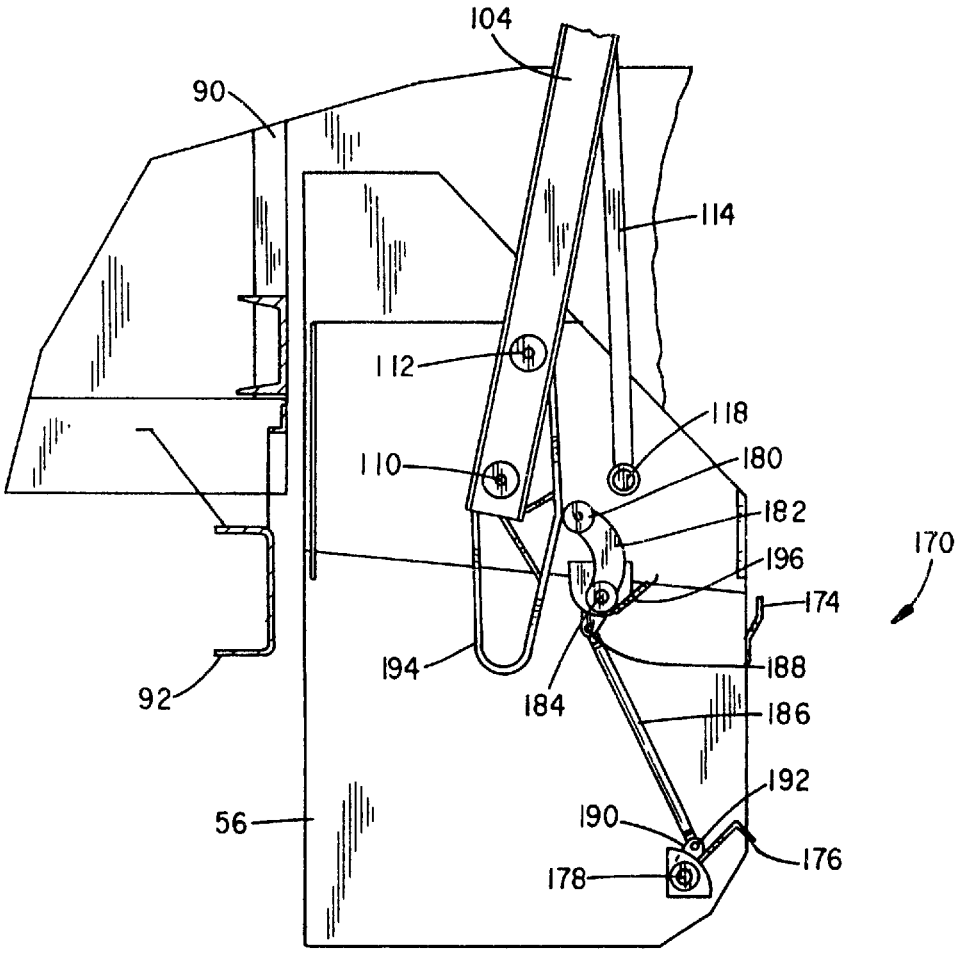
FIGS. 7 and 8 are greatly enlarged fragmentary side views showing the operation of a can handler attached to the bucket.
Figure 8:
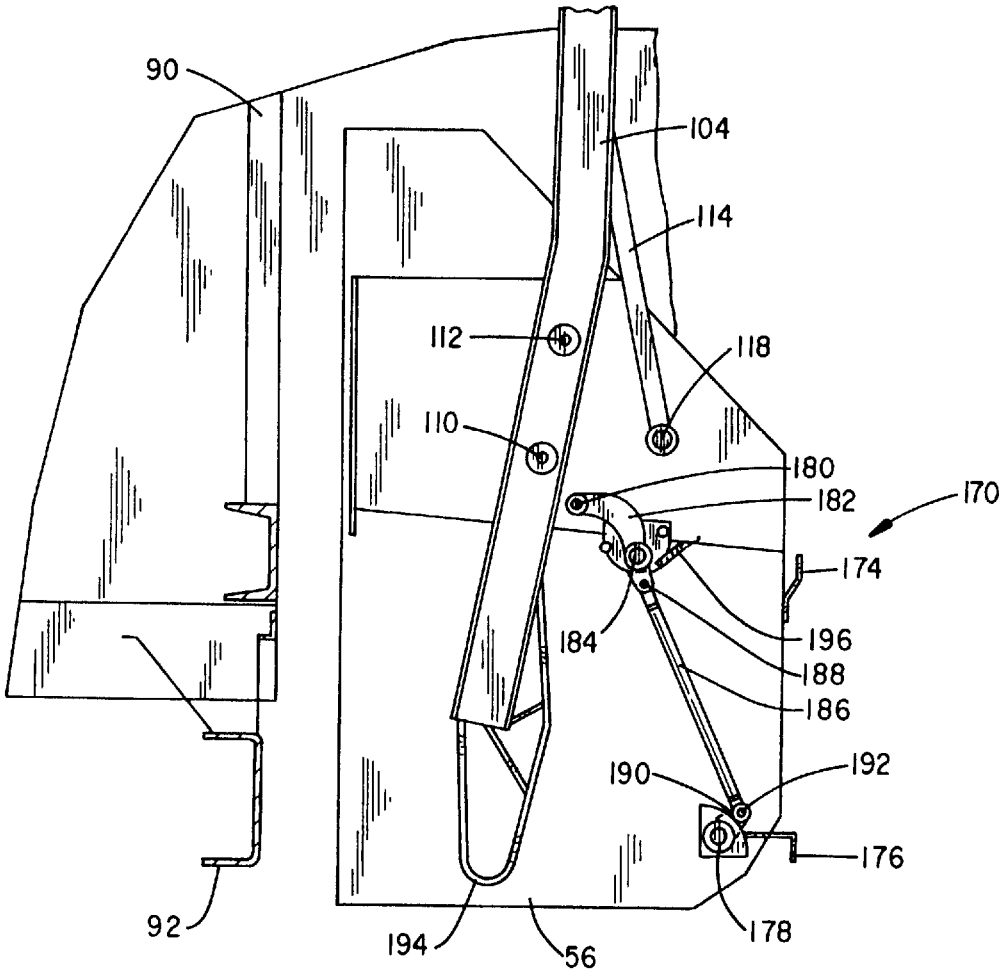

Optionally, the bucket 56 may itself be equipped to unload refuse cans. For example, refuse can handlers 170 and 172 may be attached to and built-in to the container 56 (FIG. 1). The refuse can handlers 170 and 172 are operated simultaneously by a pivoting cam arrangement on one side of the bucket 56. The refuse can handlers 170 and 172 are mechanically similar to one another. As shown in FIGS. 7 and 8, the refuse can handler 170 includes a stationary top hook member 174 securely attached to the bucket 56 and a bottom hook member 176 pivotally attached to the bucket 56 at 178. The top hook member 174 is directed upward to hold the top handle or rim of the refuse can of interest. The lower hook member 176 is recessed in the lowered position of bucket 56 and pivoted to an extended holding position as the bucket 56 is raised to the dump position. In the extended position, the lower hook member 176 engages lower handle or lip on the refuse can of interest.

The cam arrangement includes a cam roller or follower 180 rotatably attached to a cam lever arm 182 which is pivotally attached to the container 56 at 184. A lever arm push rod 186 is pivotally attached to the cam lever arm 182 at 188 and to hook lever arm 190 which operates hook 176 at 192. In the lowered or loading position, FIG. 7, a cam extension 194 which is attached to the guide channel 104 operates the cam roller 180 and arm 182 to pivot the lower hook member 176 about 178 to the recessed position. As the bucket 56 is raised by lifting forces applied to lift rod 114 which is pivotally attached to the loading bin 56 at 118, the loading bin guide rollers 110 and 112 slide or roll in the guide channel 104 and the cam roller 180 is disengaged from the cam extension 194. A spring 196 is attached to the cam lever arm 182 and the bin 56 to apply bias and pivot the lever arm 182 about 184. This pushes on the rod 186 and lever arm 190 to pivot the hook member 176 about 178 to the extended position and securely hold a refuse can of interest for dumping into hopper 52 as the loading bin 56 is raised to the dump position.

In another embodiment of the present invention, as shown in FIGS. 9–13, a multiple compartment refuse vehicle generally 200 includes an upper storage compartment 202 and a lower storage compartment 204 divided by a horizontal dividing panel member 206. The refuse vehicle 200 includes a hopper portion, indicated generally by 208, which may be attached to the upper and lower storage compartments 202 and 204 and which includes upper refuse hopper 210 and lower refuse hopper 212. The upper refuse hopper 210 is defined or separated by an L-shaped system including horizontal dividing member 206 which extends into the hopper portion 208 and a vertical hopper dividing wall 214 which is attached to the dividing member 206 and extends to the top door 216. The L-shaped system divides access to the hopper portion 208. Refuse which is deposited behind the hopper dividing wall 214 is dumped into the top hopper 210 and refuse which is dumped forward of the dividing wall 214 falls into the lower hopper 212. The collection vehicle 200 includes a divided loading bin or bucket 218 having a first loading bin compartment 220 and a second loading bin compartment 222. The bucket 218 is raised from a lowered position, FIGS. 9 and 10, to a discharge position, FIG. 11, wherein refuse contained in loading bin compartment 220 is dumped into the top hopper 210 and refuse contained in the loading bin compartment 222 is dumped into the lower hopper 212. A dividing wall 224 aligned with the hopper dividing wall member 214 separates the two bucket compartments 220 and 222.

The multiple compartment refuse vehicle 200 is conventual with a cab 226 and wheels 230 connected to a chassis frame 228 which carries the upper and lower storage compartments 202 and 204 and the hopper portion 208. Tailgates 232 and 234 are pivotally attached to the top storage body compartment 202 with vertically displaceable pivots 236 and 238, respectively. The lower tailgate 234 is attached to an elongated hinge member 240 which is pivotally connected to the vertically displaceable pivot joint 238. Hydraulic cylinders 242 and 244 operate to vertically displace and swing open the tailgates 232 and 234 for dumping refuse contained in the respective storage compartments 202 and 204. The tailgates 232 and 234 are held in place by hook latches 246 and 248 in a well-known manner. The truck body with upper and lower or top and bottom storage compartments 202 and 204 is pivotally attached to the chassis frame 228 at pivot 250. Hydraulic cylinder 252 which is pivotally attached to the body at 254 and to frame extension 256 at 258 is operated to lift the truck body 200 with attached hopper portion 208 to dump refuse from the storage compartments 202 and 204. Refuse is moved into the top storage compartment 202 by operating a top or upper packer 260 situated in the top hopper 210 between a forward position and a packing position. Similarly, refuse is moved and packed into the lower storage compartment 204 by a lower packer 262 situated in the lower hopper portion 212 and operated between a forward and a packing position. As described below, the upper and lower packers 260 and 262 are preferably connected together and packing forces are simultaneously applied to each.

Figure 9:
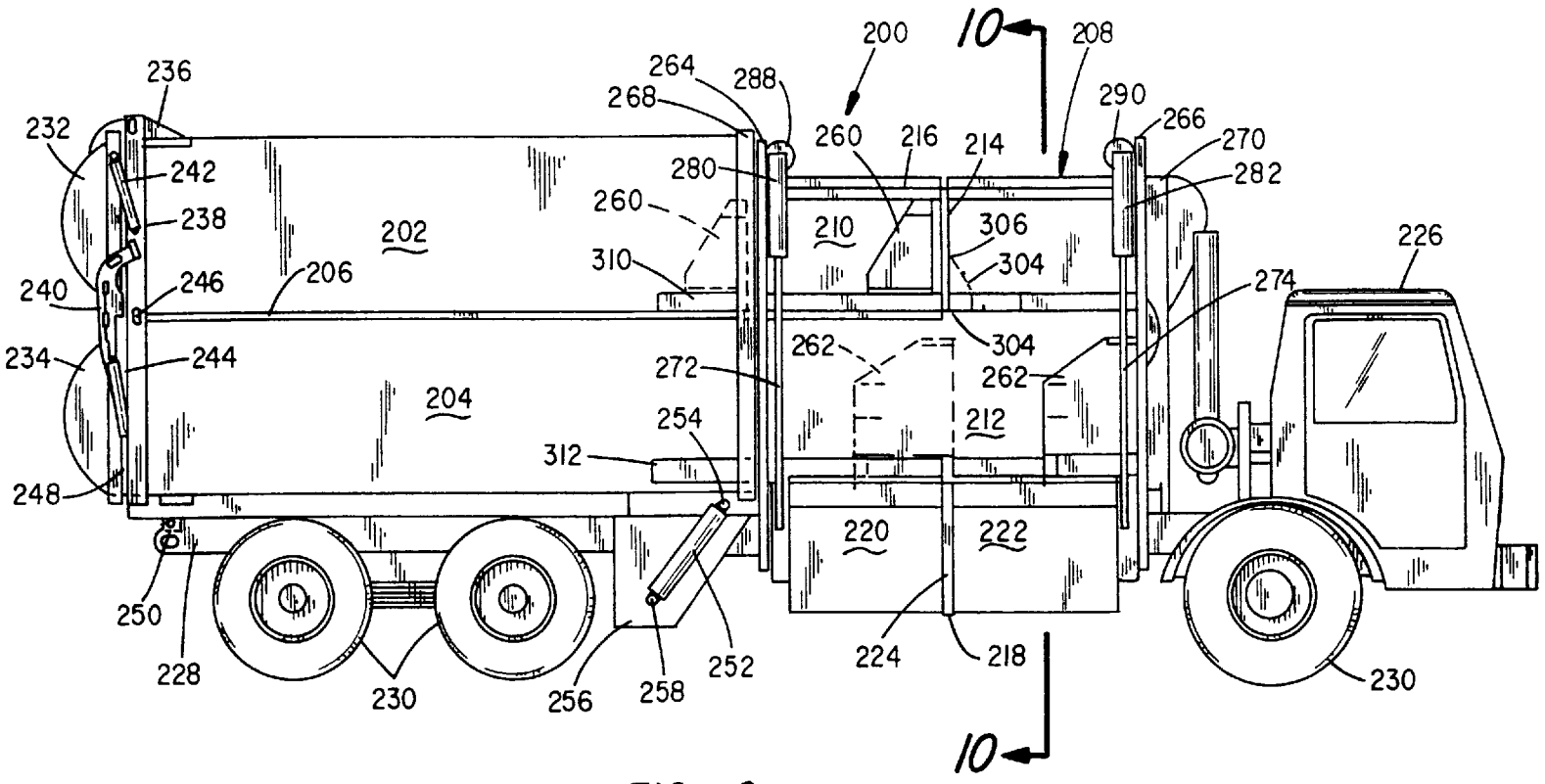
FIG. 9 is a side elevational view of a multi-compartment embodiment of the side-loading refuse vehicle of the invention.
Figure 10:
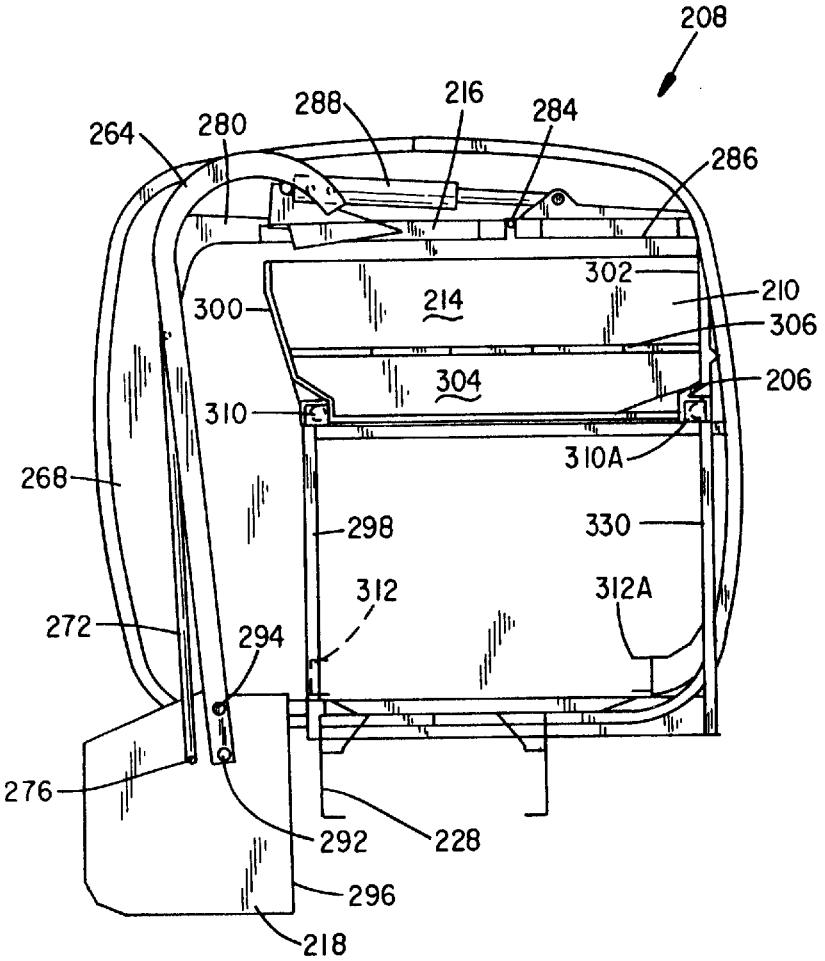
FIG. 10 is a sectional view taken substantially along 10—10 of FIG. 9.
Figure 11:
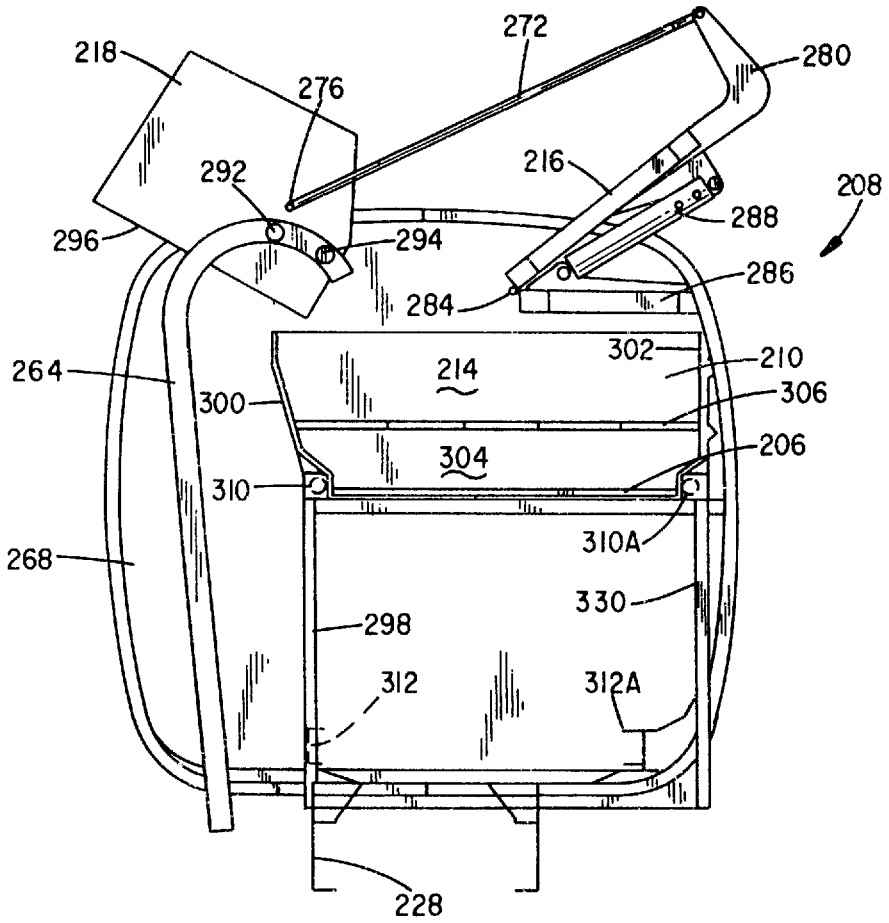
FIG. 11 is a view similar to FIG. 10 illustrating the bucket in the raised or discharging position.
Figure 12:
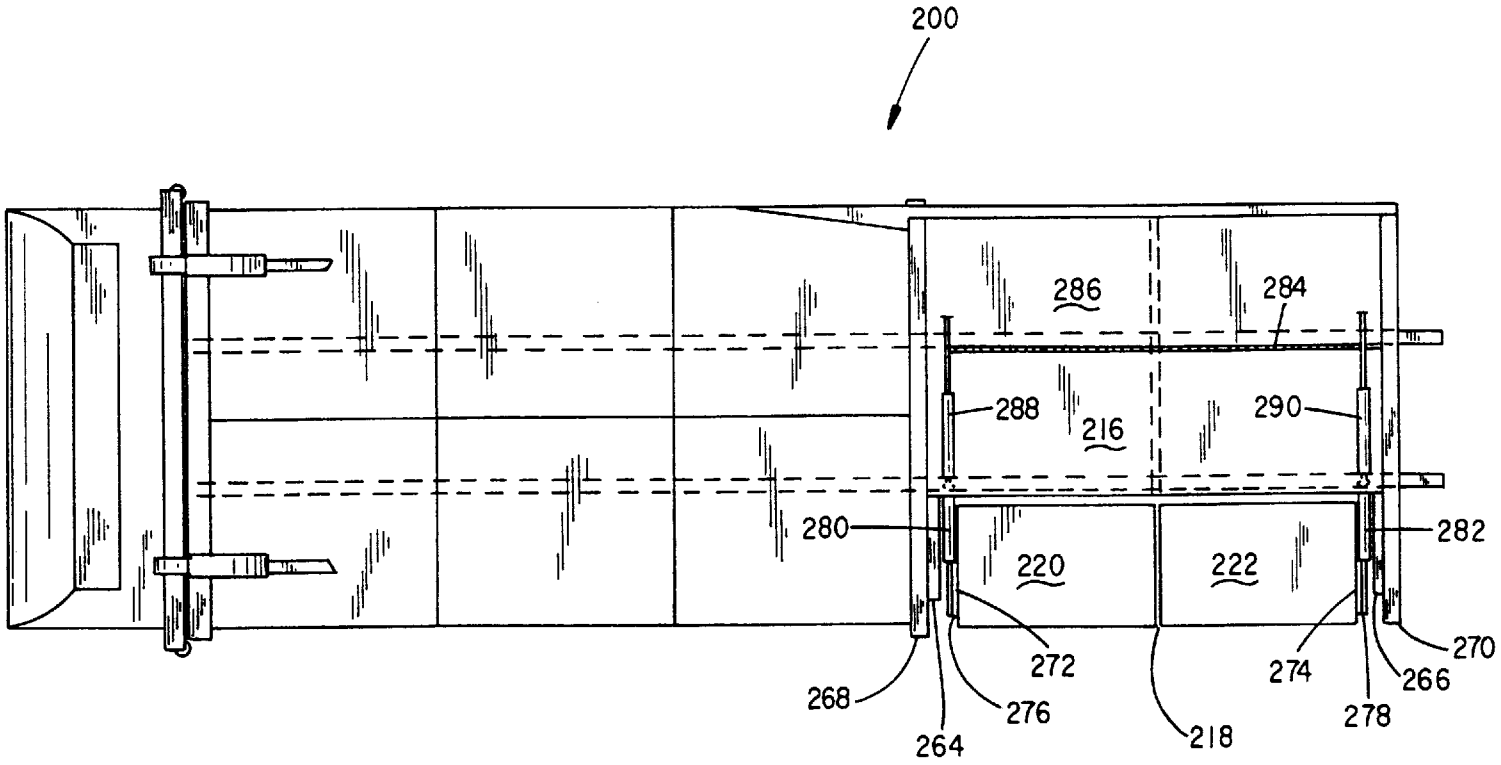
FIG. 12 is a top view of the truck body and charging hopper of FIG. 9.

As shown in FIGS. 9–12, the split or divided loading bin or bucket 218 is raised from the lowered resting position, FIGS. 9, 10, and 12, to the dump position FIG. 11. The loading bin 218 is adapted to ride in candy cane shaped guide channels 264 and 266 which are attached to the storage compartment front wall 268 and the hopper front wall 270, respectively. The split loading bin 218 is pivotally attached at each end to lift rods 272 and 274 at 276 and 278. The lift rods 272 and 274 are pivotally attached to lift arms 280 and 282 which are attached to the hopper top door 216 which, in turn, is pivotally attached at 284 to a stationary hopper top 286. Hydraulic cylinders 288 and 290 are pivotally attached to the stationary hopper portion top 286 and the door 216.

The split loading bucket 218 is connected to ride in the candy cane shaped guide channels 264 and 266 by rollers 292 and 294 rotatably attached to the loading bin 218. The rollers 292 and 294, such as nylon rollers, are slidably and rotatably engaged in the candy cane shaped channels 264 and 266.

The guide channels 264 and 266 are straight-legged candy cane shaped channels which guide the split compartment loading bin 218 from the lowered position, as in FIG. 10, to the dump position, FIG. 11. As in the previous embodiment, the channels 264 and 266 are angled away from the hopper portion 208 from the lower end to the upper end and curved at the upper end to guide the loading bin 218 in an arcuate path. Roller 292 is closer to the back wall 296 of the loading bin 218 compared to the upper roller 294 so that in the lowered position, the loading bin 218 is essentially plumb and positioned close adjacent sidewall 298 and chassis frame support member 228. In the dump position, the position of the rollers 292 and 294 wherein the lower roller 292 is closer to the back wall 296 of the loading bin 218 tips the loading bin 218 more advantageously for dumping.

In this embodiment, the hopper 208 includes a flared sidewall 300 which is attached to and extending away from the lower hopper sidewall 298. The flared sidewall 300 is angled away from the lower hopper sidewall 298 to enlarge the available opening for both the upper hopper 210 and lower hopper 212. The flared sidewall 300 and the angled candy cane shaped guide channels 264 and 266 provide room for dumping split loading bin 218. The loading bucket 218 may be as wide as the distance from the chassis frame 228 to the outside of the storage body compartments 202 and 204 and in some cases even wider if bin 218 may extend beyond the storage compartments 202 and 204 on one side of the refuse vehicle 200.

Hopper divider 214 is attached to the flared sidewall 300 and the opposing sidewall 302 and may be provided with a self-cleaning feature. A swinging door segment 304 is provided in member 214 behind the packer blade 260 pivotally attached, such as with a hinge, along the line 306. The bottom of the swinging door 304 is aligned with the dividing member 206 and in a resting position the swinging door 304 hangs straight down from the dividing member 214.

As shown in FIGS. 9–11 and 13, the upper compaction panel or top packer 260 rides in upper guide tracks or rails 310 and 310A and the lower compaction panel or lower packer 262 rides on corresponding lower guide tracks or rails 312 and 312A. The upper and lower compaction panels or packers 260 and 262 are provided with wearshoes including slide bars that slidably engage the corresponding guide tracks or rails 310, 310A, 312, and 312A. The wearshoes and slide bars slide in the guide tracks in a well-known manner. A representative compliant linkage system is illustrated that links the operation of the upper compaction panel or packer 260 to that of the lower compaction panel or packer 262. The compliant linkage system limits the force applied to the upper compaction panel so glass or other non-compressible materials may be moved without breakage. Initial packing forces are applied to the lower compaction panel or packer 262 in a manner similar to that shown in FIG. 5 for the single compartment vehicle. The compliant linkage system includes a pair of identical spring piston systems, one of which is indicated at 314, each of which is situated within an upper panel guide rail 310 and 310A. The spring-piston system 314 includes an inner telescoping linkage tube 316 that floats inside of an outer telescoping linkage tube 318. The inner telescopic linkage tube 316 is pivotally connected at 322 to a lower linkage lever 320 which is secured to the lower compaction panel or packer 262. A compliant spring (not shown) is attached to the outer telescoping linkage tube 318 near the upper compaction panel or packer 260 at one end and to the inner telescoping tube 316 at the other end.

In operation, the lower compaction panel packer 262 is moved from the forward position through the lower hopper 212 by vertically stacked hydraulic cylinders, such as those shown in FIG. 5 for the single compartment vehicle. The lower compaction panel 262 moves through the lower hopper 212 to the packing position and the lower linkage lever 320 pushes on the inner telescoping tube 316 which applies pressure to the internal spring and the outer telescoping linkage tube 318 which is secured to the upper compaction panel or packer 260. This applies a bias to the upper compaction panel from the forward position, toward the packing position. If the upper compaction panel 260 meets sufficient resistance to be prevented from moving rearward, the lower compaction panel 262 may continue to move rearward as the spring in the spring-piston system 314 compresses. This is one compliant linkage system which may be used with the present invention to pack material in a multiple compartment vehicle, such as 200. Further, the details of this mechanism and others which may be used with the present invention may be found in U.S. patent application Ser. No. 08/389,097, filed Feb. 15, 1995, by Ronald E. Christenson, the disclosure of which is hereby incorporated by reference in its entirety for any necessary purposes.

Figure 13:
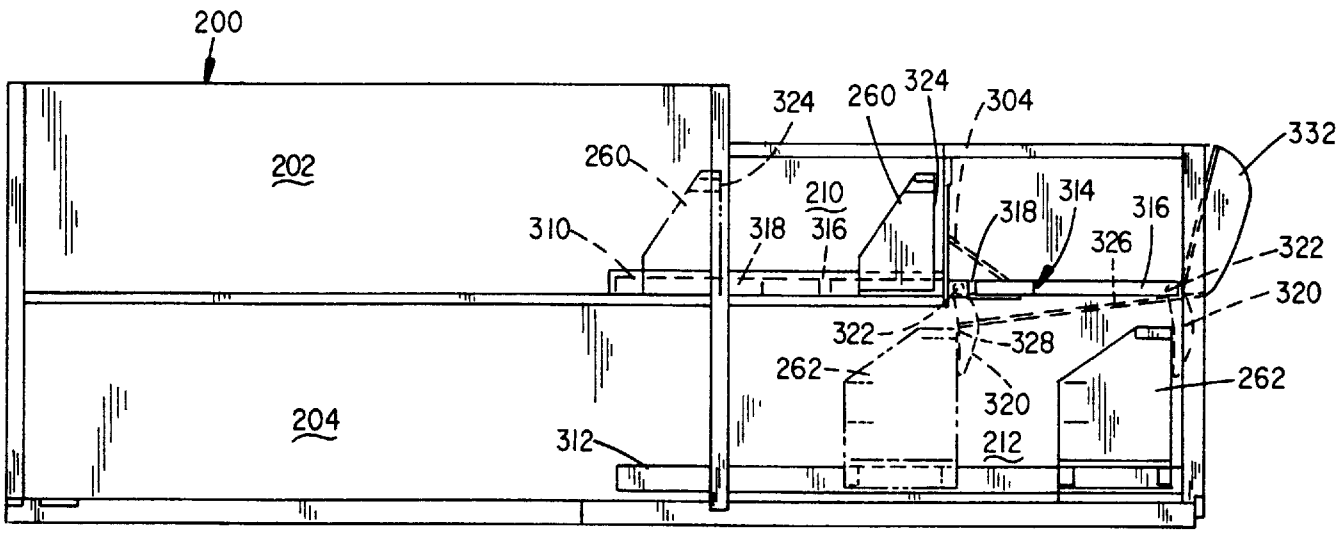
FIG. 13 is a slightly enlarged side elevational view, partially in section, of the truck body and charging hopper of FIG. 9 showing additional details.
Figure 14:
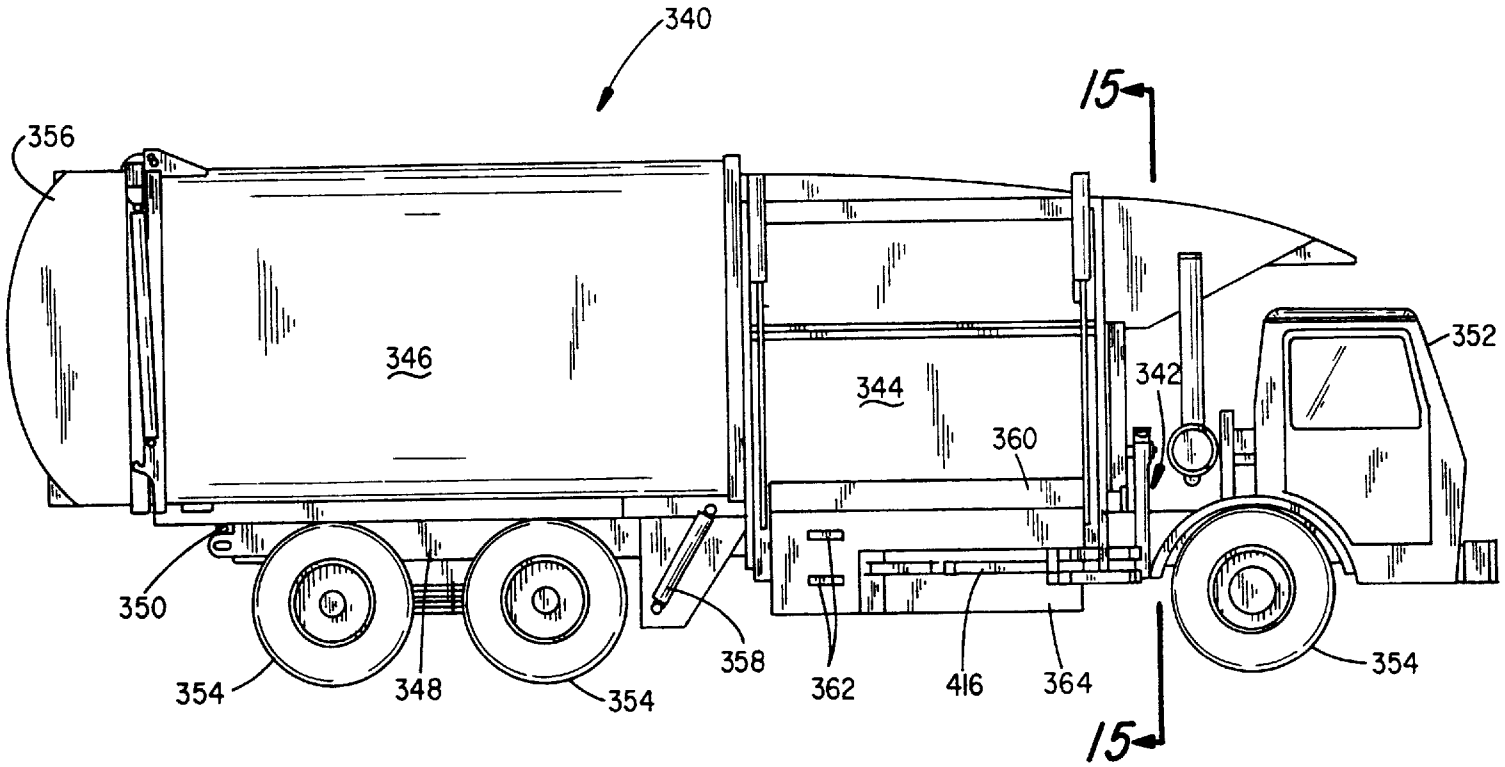
FIG. 14 is a side view of a single compartment embodiment similar to that of FIG. 1, but including an automated boom arm and grabber system.

As depicted in FIG. 13, the upper compaction panel 260 includes a solid back wall 324 which pushes any material or refuse which falls behind the upper compaction panel 260 through the swinging door 304 as the upper compaction panel 260 is pulled back to the forward position by the lower compaction panel 262 and the interconnecting telescoping linkage tubes 316 and 318. This aspect provides a self-cleaning mechanism for the upper hopper portion 210 of the refuse vehicle 200. A follower panel 326 is pivotally attached to the lower compaction panel 262 at 328 and extends between the sidewall 298 and an opposing sidewall 330 to prevent material or refuse from falling behind the lower compaction panel 262. The follower panel 326 rides up into a follower panel compartment 332 in a conventional manner as the lower compaction panel 262 is returned from the packing position to the forward position.

In another embodiment, as shown in FIGS. 14–19, a single compartment collection vehicle 340 includes an automated arm, indicated generally at 342, for lifting and dumping a refuse container of interest into a single compartment hopper 344. The collection vehicle 340 is similar to that of FIG. 1 and includes a storage body 346 pivotally attached to a chassis frame 348 at 350. The collection vehicle 340 further includes a cab 352, wheels 354 and a tailgate 356 connected to the storage body 346 as previously described. The automated arm 342 is securely attached to the frame 348. Lift and dump cylinder 358 is attached in a well-known manner and extended to lift the storage body 346 and hopper 344 to a dumping or unloading position. The automated arm 342 remains attached to the frame 348 and is not lifted with the hopper 344.

The refuse vehicle 340 includes a single compartment loading bucket 360 and the lift and dump mechanism may be the same as that described for the embodiment shown in FIGS. 1–8 and the description need not be repeated here. The loading bin 360 may include a refuse can handler 362 (previously described) and has a recessed lower recessed portion 364 in which a portion of the automated arm 342 fits in a lowered stowed position. The refuse can handler 362 operates the same as the refuse can handler 170 shown in FIGS. 1, 7 and 8. The hopper 344 and packer or compaction panel (not shown) also may be the same as that used in the embodiment shown in FIG. 1.

The automated arm 342 includes an extensible boom 366 and a grabber system or lifting and holding mechanism 368 pivotally attached to the extensible boom 366 at 370. The extensible boom 366 includes an inner boom arm 372 inserted in an outer boom arm 374. The inner boom arm 372 includes rollers 376 at one end and the outer boom arm 374 includes rollers 378 for sliding the inner boom arm 372 in and out of the outer boom arm 374. The inner boom arm 372 is secured to a boom mount 380 which is pivotally attached to frame extension 382 at 384. Boom lift cylinder 386 is pivotally attached to a second frame extension 388 at 390 and to the inner boom arm 372 at 392. The outer boom arm 374 includes a slot 394 through which the boom lift cylinder 386 is attached to the inner boom arm 372. A boom extension cylinder 396 is attached at the butt end to boom arm support member 380 and at the rod end to the outer boom arm 374. In operation, the boom extension cylinder 396 is extended to move the outer boom arm 374 away from the vehicle 340. The pivotal connection 392 between the boom lift cylinder 386 and the inner boom arm 372 slides in the slot 394 to avoid interference with movement of the outer boom arm 374.

Figure 15:
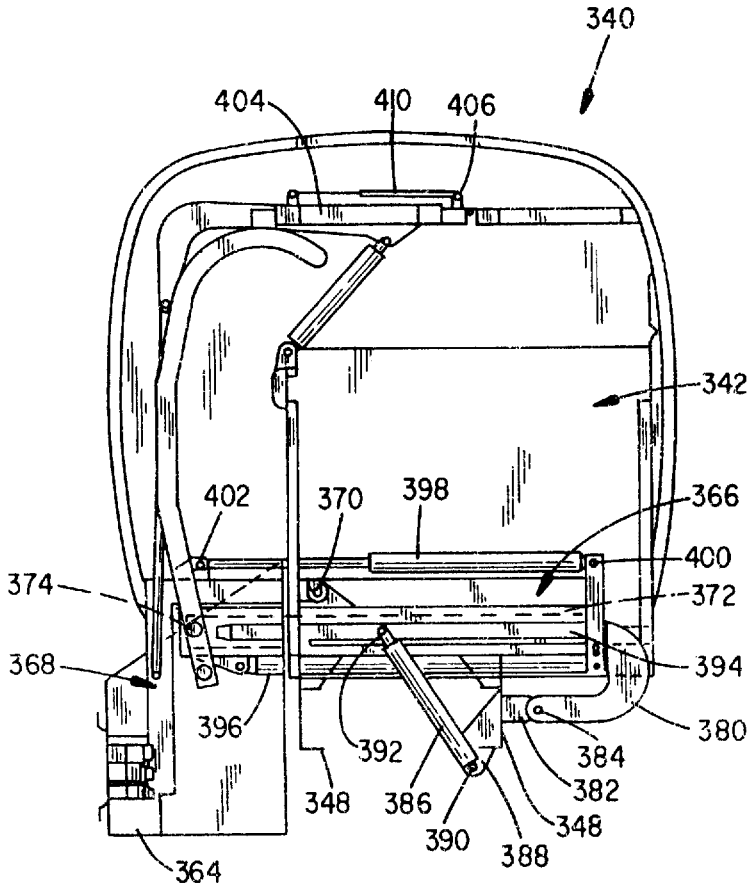
FIG. 15 is a sectional view taken substantially along line 15—15 of FIG. 14 depicting both the bucket and boom arm and grabber system lowered and stowed positions.
Figure 16:
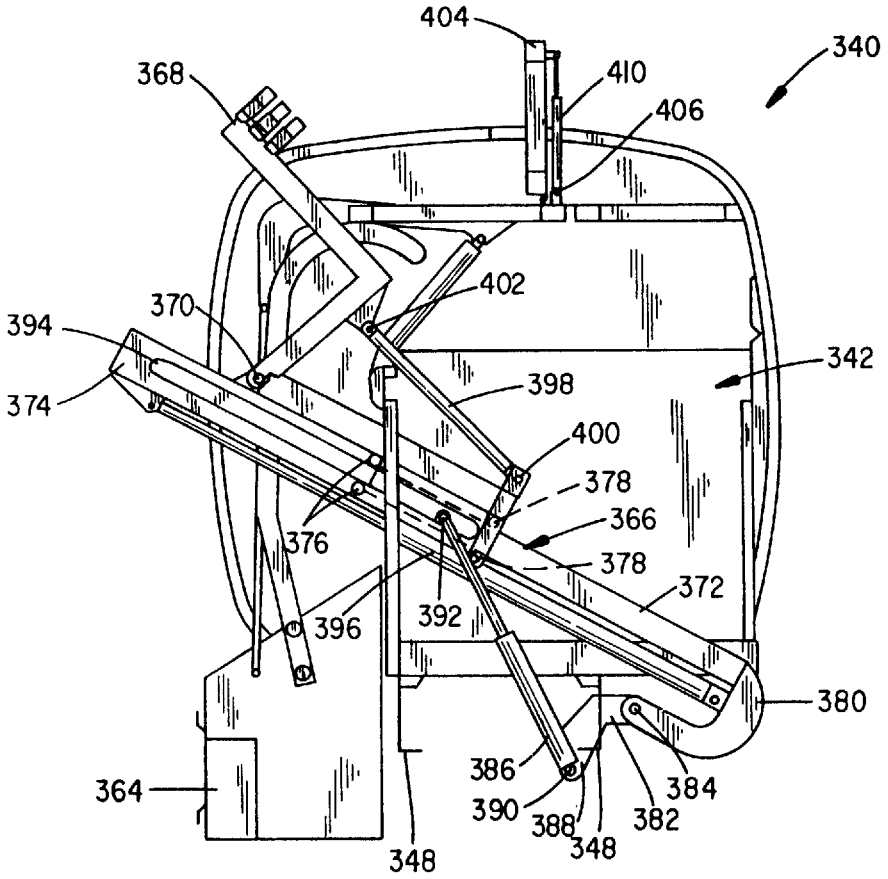
FIG. 16 is a view similar to FIG. 15 with the boom arm and grabber system in the raised, container dumping position.
Figure 17:
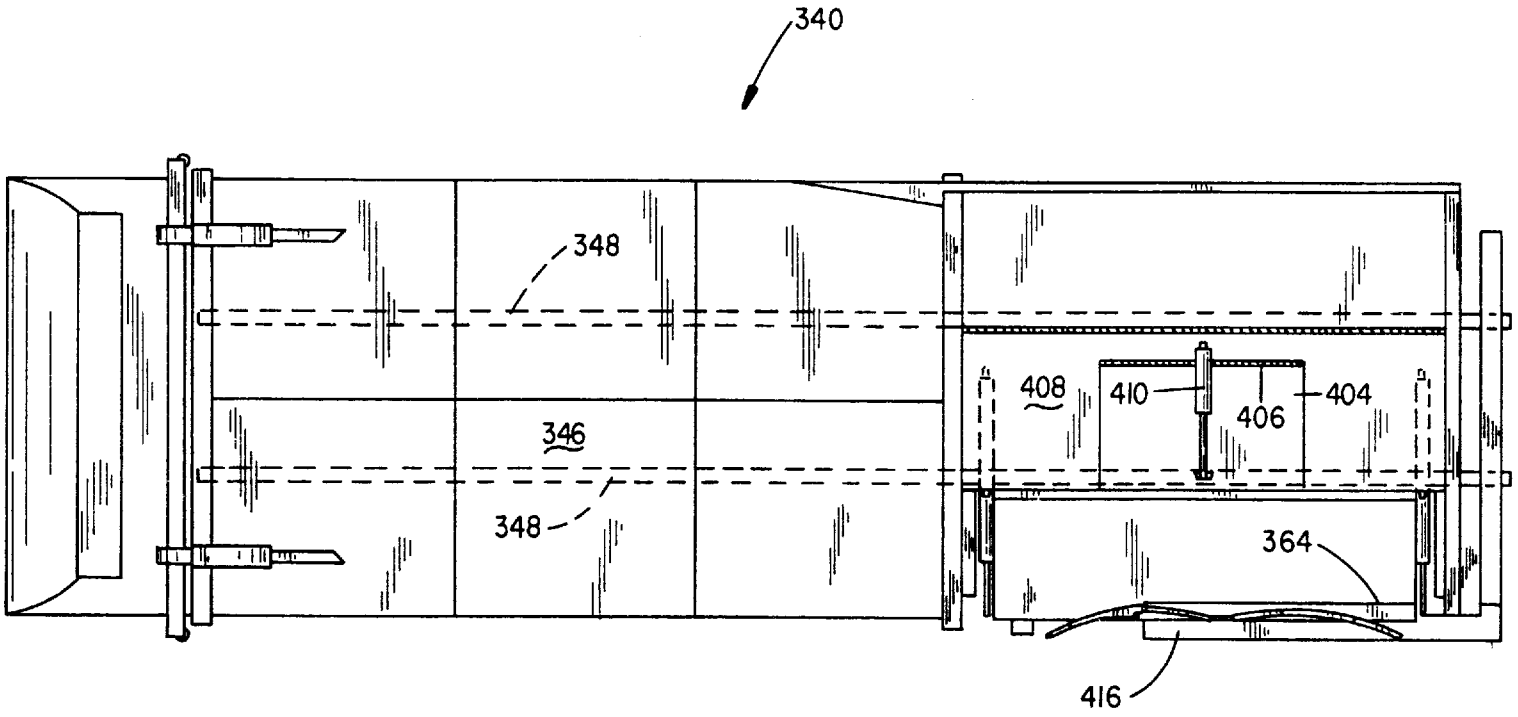
FIG. 17 is a slightly enlarged top view of the truck body and hopper of FIG. 14.

In the lowered position of FIG. 15, the boom extension cylinder 396 may be extended to position the lift and hold mechanism 368 against a refuse container or can of interest. The lift and hold mechanism is operated as described below to grasp and hold a container of interest. The boom lift cylinder 386 is then extended, as shown in FIG. 16, to pivot the extensible boom 366 about pivot 384 and raise the container. A dump hydraulic cylinder 398 is pivotally attached to the upper portion of outer boom arm 374 at 400 and to the mechanism 368 at 402. To dump a held container, the dump cylinder 398 is retracted to pivot the mechanism 368 about pivot 370. A second door 404 is provided pivotally attached at 406, such as with a hinge, to the hopper top door 408. The small door 404 is pivoted to an open position by hydraulic cylinder 410 as the automated arm 342 is moved to the dump position (FIG. 16).

Figure 18:
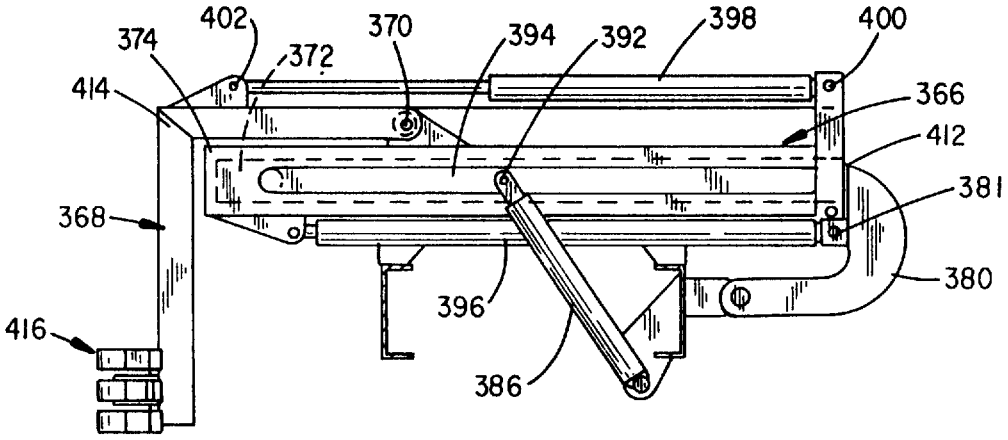
FIG. 18 is an enlarged detail front view of the boom arm and grabber system in the lowered and stowed position.
Figure 19:
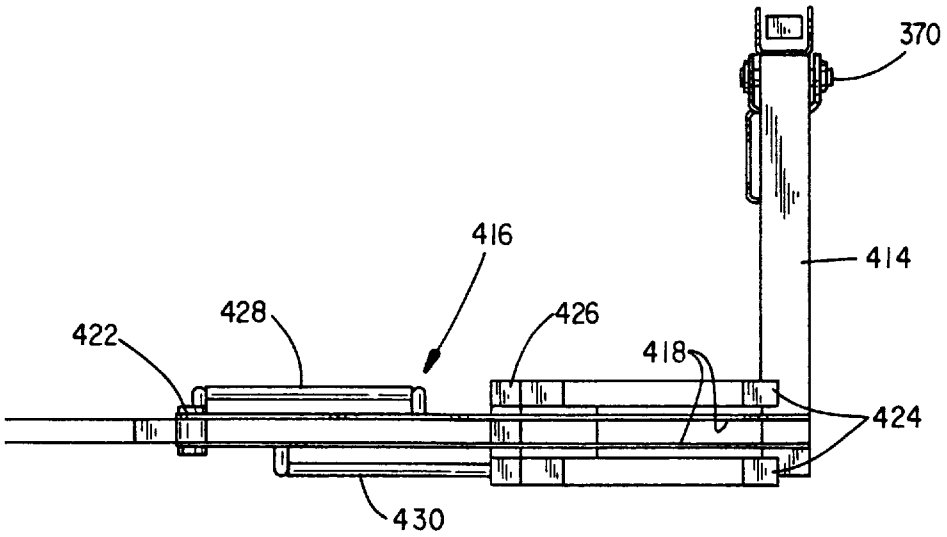
FIG. 19 is a greatly enlarged detail side view of the grabber mechanism of FIG. 18.

In the stowed position, as best seen in FIGS. 18 and 19, the inner boom arm 372 of the extensible boom is fully inserted in the outer boom arm 374. A small plate 412 is secured at the back end of the inner boom arm 372 and secured to the extensible boom arm support member 380. The slot 394 in the outer boom arm 374 provides clearance for the pivotal connection 392 between the inner boom arm 372 and the boom lift cylinder 386. The boom extension cylinder 396 is situated below outer arm 374 and is attached to the support member 380 at 381. The dump cylinder 398 is pivotally attached to the outer boom arm 374 at 400 on top of the outer boom arm 374 and to the lift and hold mechanism 368 at 402.

The lift and hold mechanism 368 includes a lift arm 414 which is pivotally attached to the outer boom arm 374 at 370 and which forms a right angle over the end of the outer boom arm 374. As best seen in the enlarged detail of FIG. 19, a refuse can holding apparatus or grabber 416 is provided that includes a grabber frame 418 attached to lift arm 414. A single appendage or digit 420 is pivotally attached to the grabber frame 418 at 422 and a double appendage or double digit segment 424 is pivotally attached to the grabber 418 at 426. The single appendage or digit 420 is operated between an open position and a grasping position by hydraulic cylinder 428 which is pivotally attached to the singe appendage 420 and the grabber frame 418. Similarly, the double appendage 424 is operated between an open and a grasping position by hydraulic cylinder 430 which is pivotally attached to the grabber frame 418 and the double appendage 424.

In operation, the extensible boom 366 is extended by operating boom extension cylinder 396 to move the outer arm 374 over the inner arm 372. The holding apparatus 416 is positioned next to a container of interest and hydraulic cylinders 428 and 430 are operated to pivot the single appendage 420 and the double appendage 424 to the grasping position. The extensible boom 366 is then retracted or extended by operating boom extension cylinder 396 and the boom 366 is raised to the dump position (FIG. 16), by operating lift cylinder 386. Door 404 is opened by operating cylinder 410 and the lift arm 414 is pivoted about pivot 370 to dump the container of interest into the hopper 344. The automated arm 342 is returned to the lowered or stowed position by extending dump cylinder 398 and retracting the lift cylinder 386 and the boom extension cylinder 396. In the stowed position, the grabbing apparatus 416 fits into the recess 364 in the loading bin 360.

Figure 20:
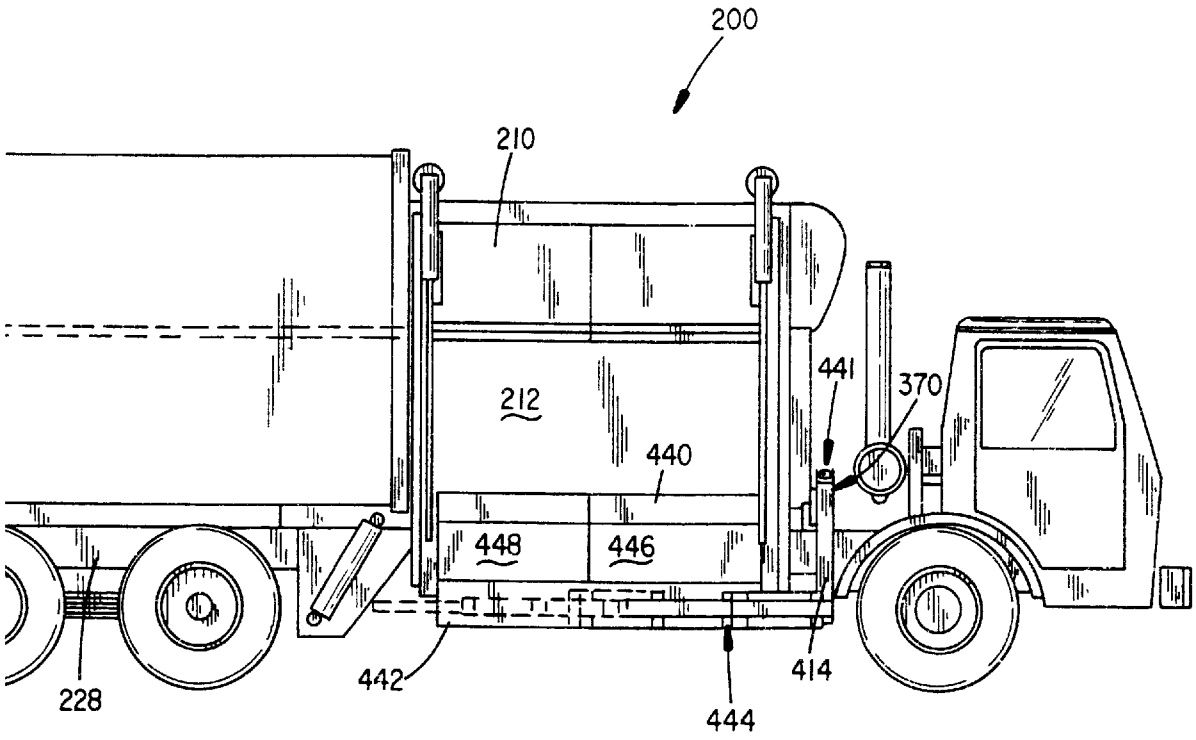
FIG. 20 is a side elevated view of a multiple compartment side-loading refuse vehicle including an automated boom arm and grabber system for dumping refuse into either the forward or aft charging hopper.

FIG. 20 depicts the multiple compartment refuse vehicle 200 of FIG. 9 with the loading bin or bucket 218 replaced by a recessed loading bin or bucket 440. An automated arm 441 is also provided. The recessed bucket 440 includes a recessed portion 442 which may extend the length of the bucket 440 and which accommodates the holding or grabber apparatus, indicated generally by the numeral 444. The automated arm 441 includes the extensible boom 366 (FIGS. 21 and 22) and the lift arm 414 pivotally attached to the extensible boom at 370. The extensible boom 366 and lift arm 414 have been shown and described in more detail in connection with FIGS. 15, 16, 18, and 19. The recessed bucket 440 is divided into a front bucket compartment 446 and a rear bucket compartment 448 which are raised and dumped into the lower charging hopper 212 and the upper charging hopper 210. The loading apparatus 444 is attached to the lift arm 414 in a manner such that it is slidable between a forward position (solid lines) and a rearward position (dashed lines). In the forward position, the automated arm dumps refuse into the lower charging hopper 212 and in the rearward position the automated arm dumps refuse into the upper charging hopper 212.

Figure 21:
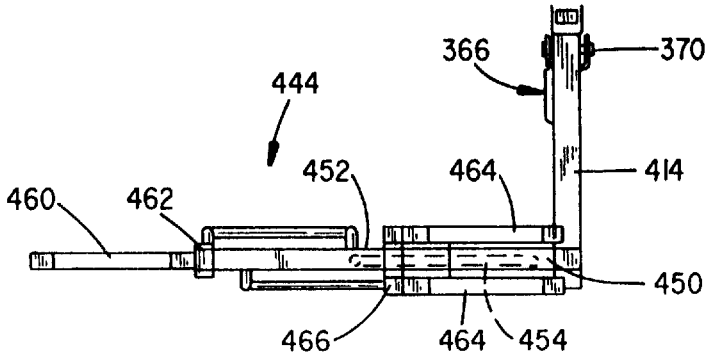
FIG. 21 is an enlarged detailed side view of an adjustable grabber mechanism in the open and forward position.
Figure 22:
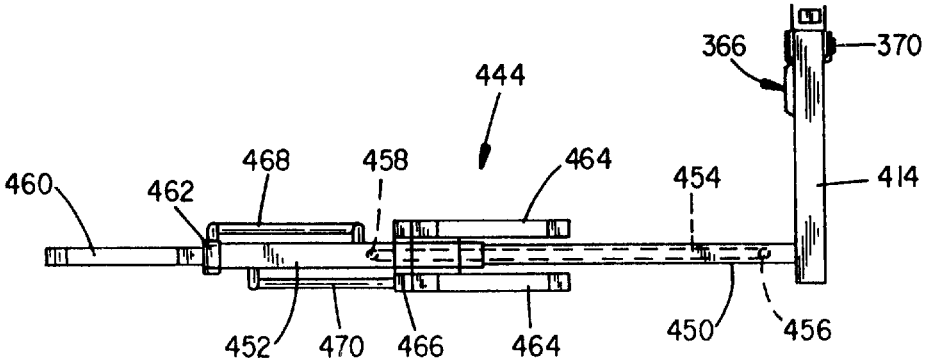
FIG. 22 is an enlarged detailed side view of the adjustable grabber mechanism in the open and rearward position.

The sliding construction is best illustrated in detailed FIGS. 21 and 22. The loading apparatus 444 includes an inner boom arm 450 attached to the lift arm 414 and an outer boom arm 452 slidably engaged over the inner boom arm 450. An hydraulic cylinder 454 is pivotally attached to the inner boom arm 450 at 456 and to the outer boom arm 452 at 458. The hydraulic cylinder 454 extends and retracts to move the holding apparatus 444 between the forward and rearward positions. A single digit appendage 460 is pivotally attached to the outer boom arm 452 at 462 and a double digit appendage 464 is pivotally attached to the outer boom arm 452 at 466. The first grasping hydraulic cylinder 468 is pivotally attached to the single digit appendage 460 and the outer boom 452 and a second grasping hydraulic cylinder 470 is pivotally attached to the double digit appendage 464 and the outer boom arm 452. The first and second grasping cylinders 468 and 470 are operated to grasp a refuse container or can of interest.

In operation, the refuse vehicle 200 is positioned to address a refuse container or can of interest and the extensible boom 366 is operated to position the holding apparatus 444 near the container of interest. The holding apparatus shift hydraulic cylinder 454 is operated to position the holding apparatus 444 for grasping the container of interest and the grasping hydraulic cylinders 468 and 470 are operated to cause the opposed digit appendages to close and grasp and hold the container of interest. Cylinder 454 is then operated to position the container of interest in line with the desired charging hopper 212 or 210 in which the container of interest is dumped.

Figure 23:
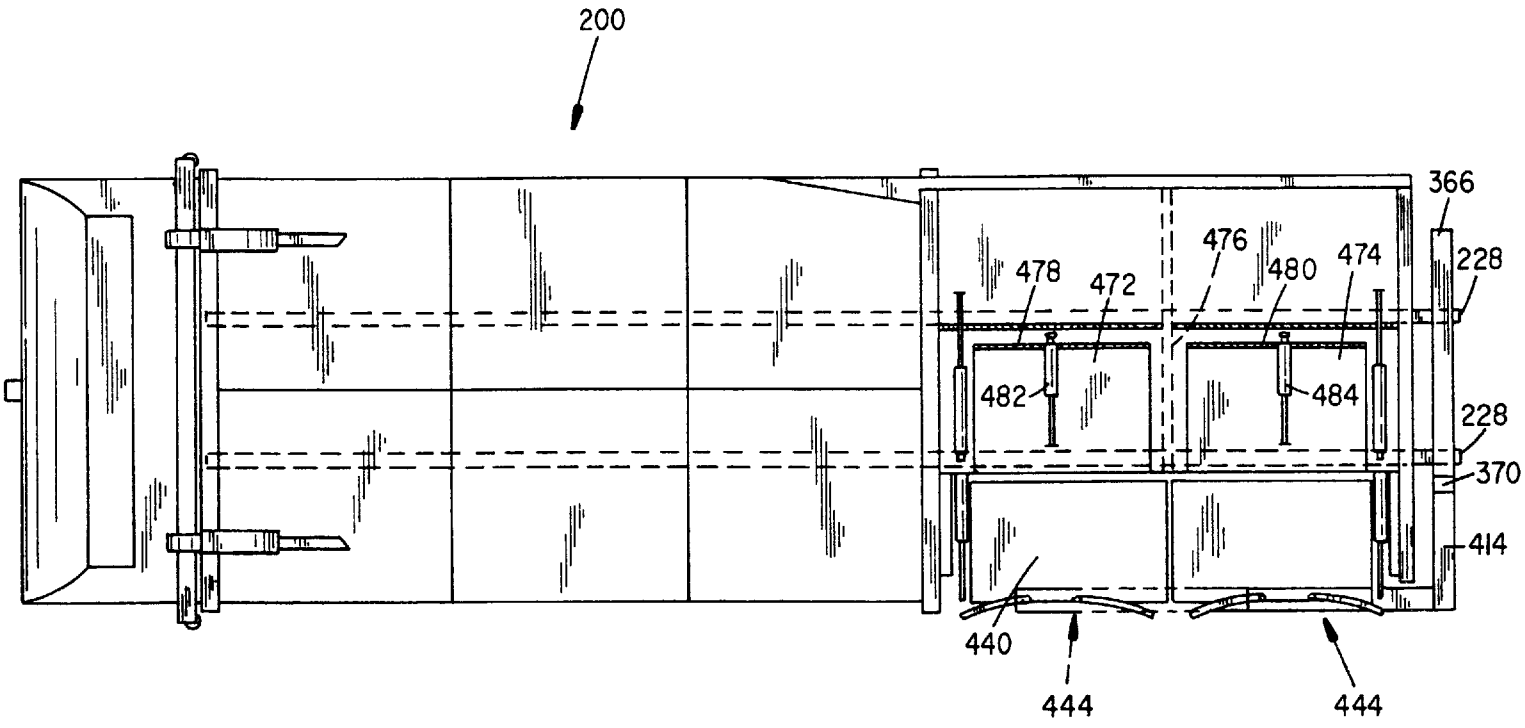
FIG. 23 is a slightly enlarged top view of the truck body and charging hopper of FIG. 20.

The containers or cans of interest manipulated by the boom and grabber system are emptied through auxiliary doors in the hopper top covers. As best shown in FIG. 23, small doors or refuse can doors 472 and 474 are provided which are pivotally hinged to a hopper top cover 476 at 478 and 480. Doors 472 and 474 are operated between a closed position and an open position by hydraulic cylinders 482 and 484 which are pivotally attached between doors 472 and 474 and the hopper top door 476. The loading apparatus 444 can be positioned to dump refuse into either the open refuse can door 472 or 474 without the need to open the hopper top cover 476. The hopper cover 476 opens as the recessed bucket 440 is raised and dumped as previously described in connection with bucket 218 and hopper top door 216 shown in FIGS. 9–13.

Figure 24:
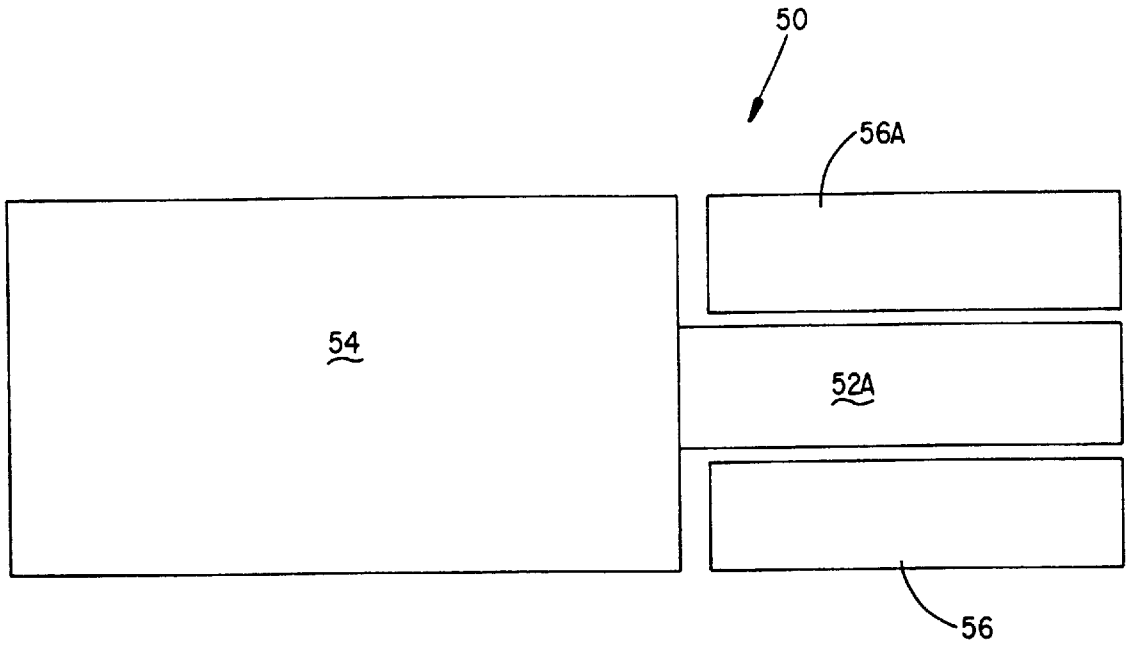
FIG. 24 is a top schematic view of a single compartment side-loading refuse vehicle including a bucket on each side of the vehicle.

FIG. 24 shows schematically that the refuse vehicle 50 of FIG. 1 may be modified to accommodate a second loading bin or bucket 56A on the other side of the vehicle 50. The loading bins 56 and 56A and the lifting mechanisms for raising the loading bins from the lowered position to the discharging or dump position, including the candy cane shaped guide channels, may be constructed as mirror images of one another on each side of the refuse vehicle 50. The refuse hopper 52 is recessed with respect to both buckets to become a smaller double recessed refuse hopper 52A which accommodates the loading bins or buckets 56 and 56A on both sides of the refuse vehicle 50. In this embodiment, the refuse hopper 52A may be provided with any of several types of covers. These include, for example, a double hinged door which opens when either lifting bin 56 or 56A is raised to the dump position, a pair of converging doors or a sliding door which slides forward or rearward during dumping operations. Of course, a door for operative use during dumping operations is not required so that a removable lid may be used but such is not necessary to the invention.

Figure 25:
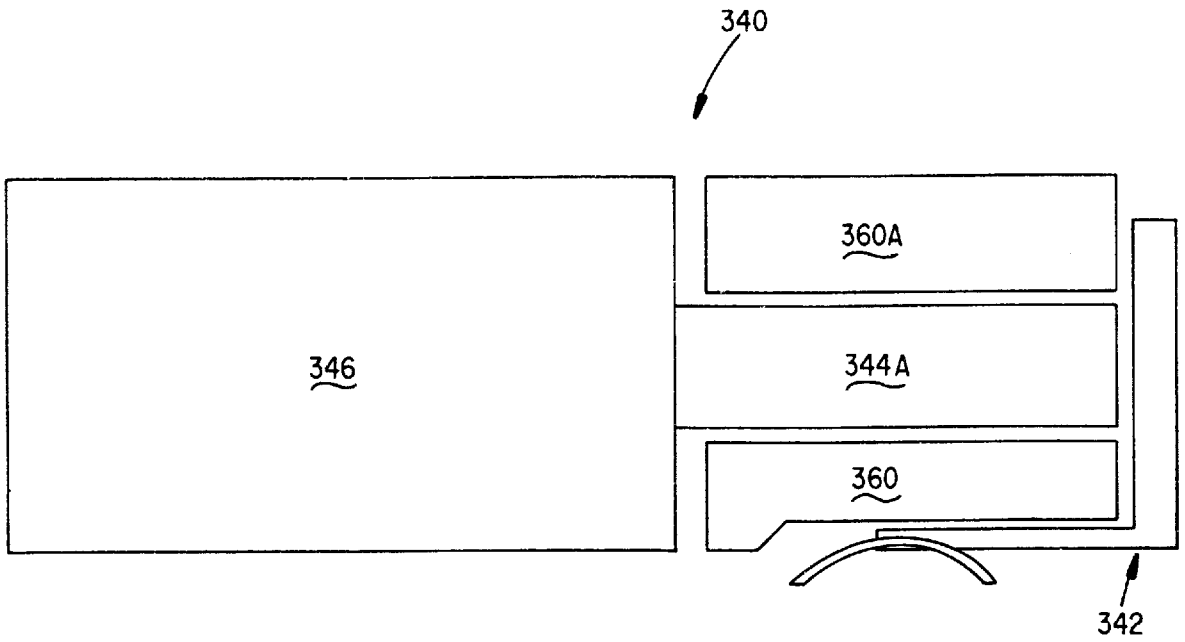
FIG. 25 is a top schematic view of a single compartment side-loading refuse vehicle including a loading bucket on each side of the charging hopper and an automated arm on one side of the vehicle.
Figure 26:
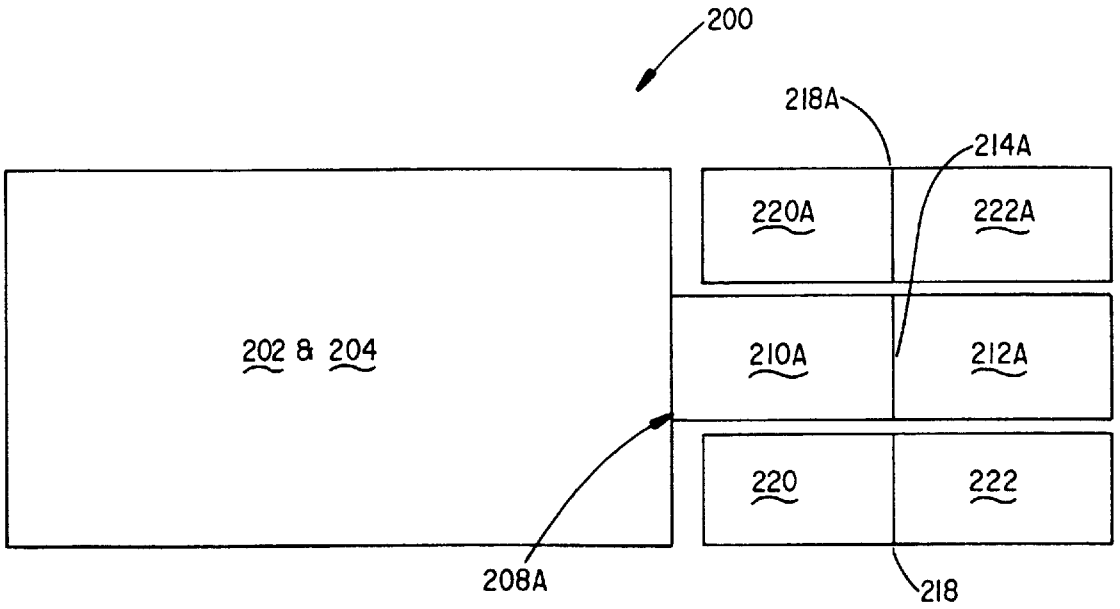
FIG. 26 is a top schematic view of a multiple compartment side-loading refuse vehicle including a split loading bucket on each side of the charging hopper.
Figure 27:
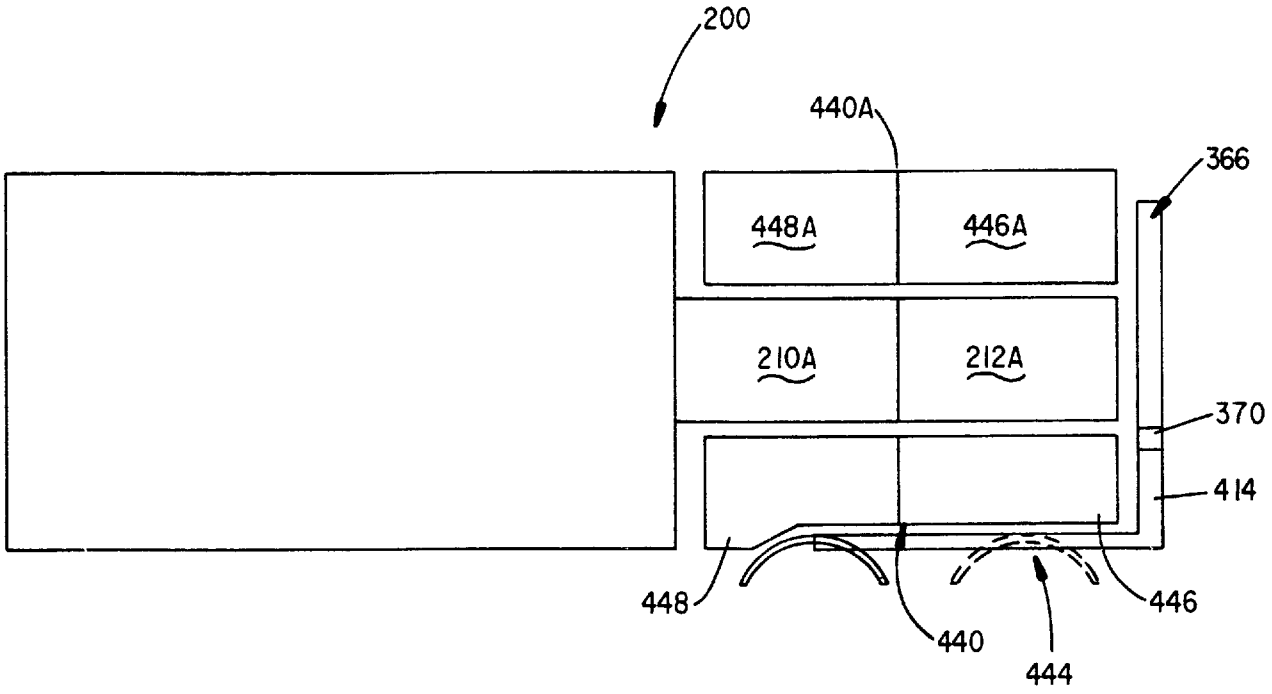
FIG. 27 is a top view schematic of a multiple compartment side-loading refuse vehicle including a multiple compartment loading bucket on each side of the vehicle and an automated arm with an adjustable grabber mechanism.
Figure 28:
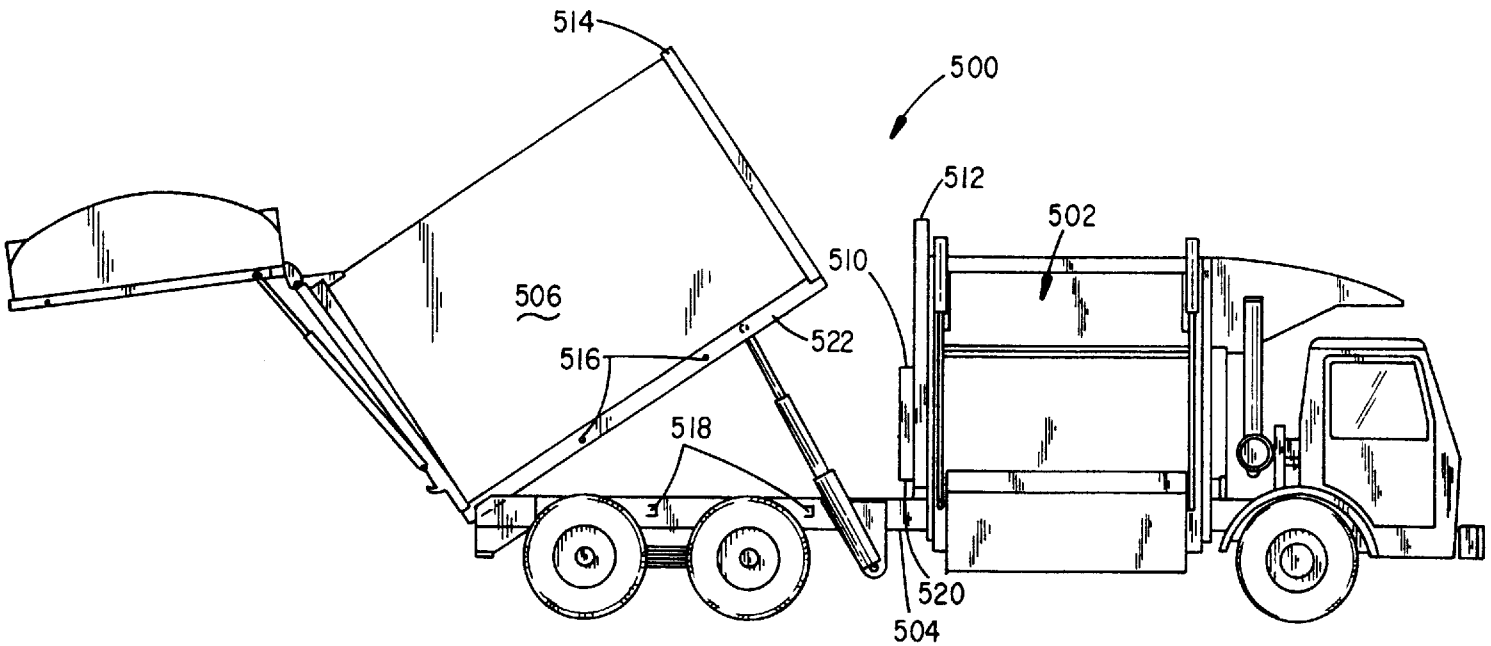
FIG. 28 is a side elevational view of a single compartment side-loading refuse vehicle including a removable body in the dump position.

Other dual bucket or double recessed embodiments are shown in FIGS. 25–27 schematically. In FIG. 25, refuse vehicle 340 such as shown in FIGS. 14–19 has been modified to accommodate a second loading bin or bucket 360A on the other side of the refuse vehicle 340. The second loading bin or bucket 360A does not include a recess for accommodating an automated arm but in all other respects bucket 360A and the lift mechanism, including the candy cane shaped guide channels may be the same as those used for the loading bin or bucket 360. The refuse hopper 344 has been recessed on each side to become smaller and double recessed hopper 344A wherein either loading bin or bucket 360 or 360A is raised from a lowered position to a dumping position above the hopper 344A. The automated arm 342 is operated in the manner previously described to hold and lift and dump refuse containers or cans directly into the refuse hopper 344A. The refuse hopper 344A may be provided with a top cover as described above in connection with FIG. 24.

It will be appreciated, as shown in FIGS. 26 and 27, that the present invention may be extended to a multiple compartment dual side bucket vehicle including multi-compartment loading bins or buckets on each side of the refuse vehicle wherein the refuse hopper has been recessed on each side to accommodate the loading bins or buckets. Thus, in FIG. 26, the refuse vehicle 200 of FIG. 9 has been modified to accommodate a split compartment loading bin or bucket 218A having a forward compartment 222A and a rearward compartment 220A on the other side of the vehicle 200. The loading bin 218A and the lifting mechanism for the loading bin 218A, including the cane shaped guide channels, may be mirror images of the loading bin 218 and guide channels 264 and 266 shown in FIGS. 9–13. The upper and lower refuse hoppers 210 and 212 have been recessed to accommodate the bucket 218A and lifting mechanism. The smaller double recessed upper and lower refuse charging hoppers 210A and 212A include packers which operate in the same manner as the packers shown in FIGS. 9–13. Also, the dividing wall 214A between the upper hopper 210A and lower hopper 212A includes a swinging door wherein the upper packer pushes refuse through the swinging door to keep the area behind the upper packer clean. The refuse hopper portion 208A is either left open or provided with a pivoting or slidable door or doors which are operated during loading operations to open the top of the hoppers 210A and 212A for receiving refuse.

In FIG. 27, the refuse vehicle 200 of FIG. 20 has been modified to include a loading bin or bucket 440A having a forward compartment 446A and a rearward compartment 448A on the other side of the vehicle 200. The bucket 440A is not shown as including a recess to accommodate a loading apparatus 444A, however, in another contemplated embodiment it could. The lifting and dumping mechanism or apparatus for dumping the bucket 440A into the upper and lower hoppers 210A and 212A, including the cane shaped guide channels and the flared sidewall portion of the hoppers 210A and 212A, is a mirror image of the lift and dump mechanism or apparatus as shown for the vehicle of FIG. 20. The upper and lower hoppers 210A and 212A may be left open or provided with a slidable or pivoting door which is operated during dumping operation.

The side-loading refuse vehicles of the present invention have been illustrated generally in FIGS. 1–27 to include hoppers which are attached to the storage body and lifted with the storage body as the refuse is dumped from the vehicle. However, each of the side-loading vehicles are also readily built using a removable storage body which is separable from the hopper to be tilted or removed for unloading. In these embodiments, as shown in FIGS. 28–35, the collection vehicle, which may be any type of vehicle previously described and contemplated has a removable body. As shown in FIGS. 28–34, a single compartment collection vehicle 500 includes a hopper section 502 which is securely fastened or attached to a chassis frame 504. A storage body 506 is releasably attached to a subframe 508 (FIGS. 29–34), which is, in turn, pivotally attached to the chassis frame 504, in a manner described below. The hopper section 502 is situated slightly higher on the chassis frame 504, as compared to the previous embodiments, and is provided with hopper walls 510 and floor 520 which extend beyond the back wall of the hopper 512 to interface with a hole in the storage body front wall 514. In a lowered and latched position (not shown), the storage body 506 is fastened to the subframe 508 and pegs 516, which are attached to the storage body 506, are slidably engaged in rearward facing hooks 518 secured to the chassis frame 504. The hopper walls 510 and floor 520 extend through the storage body front wall 514 and into the storage body 506 such that refuse is moved from the hopper 502 and pushed along the hopper floor 520 between the hopper sidewalls 510 into the storage body 506. The hopper floor 520 is situated above the chassis frame 504 and, in the lowered and latched position, above the floor of the storage body 506. The storage body front wall 514 is provided with a lip above the storage body floor which prevents fluids from flowing out of the storage body 506.

Figure 29:
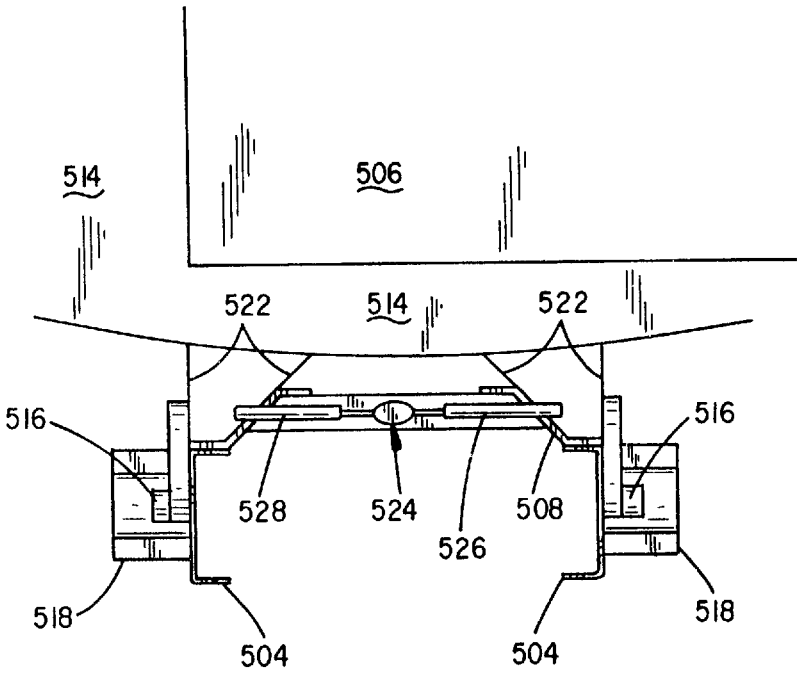
FIG. 29 is a fragmentary cross-sectional view of the refuse vehicle showing positioning of the body on the mechanized subframe and the chassis frame.
Figure 30:
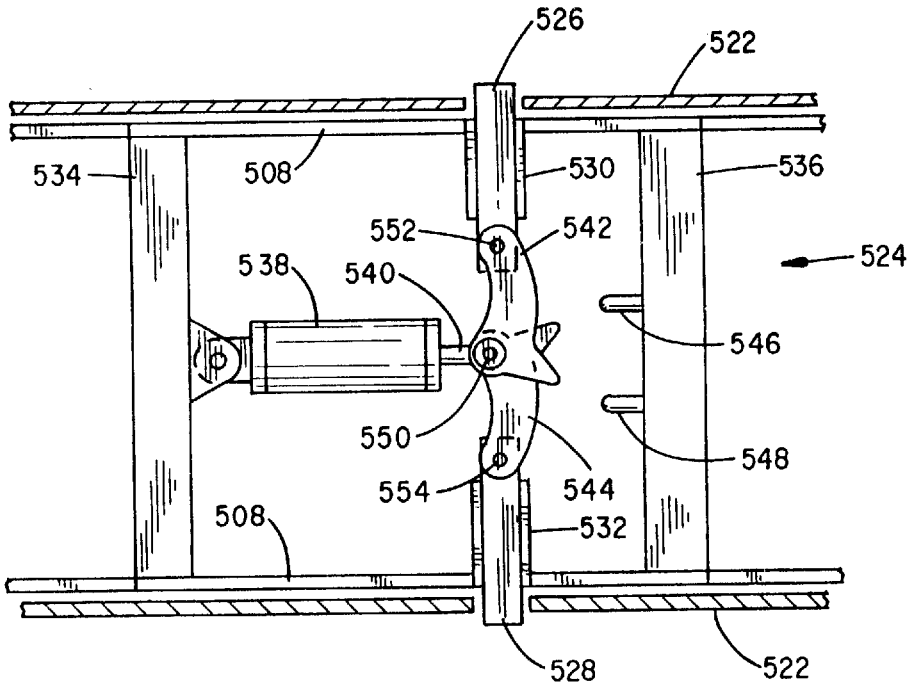
FIGS. 30 and 31 are plan views, partially in section, depicting a locking system for holding a removable body on the subframe shown in the locked and unlocked positions, respectively.
Figure 31:
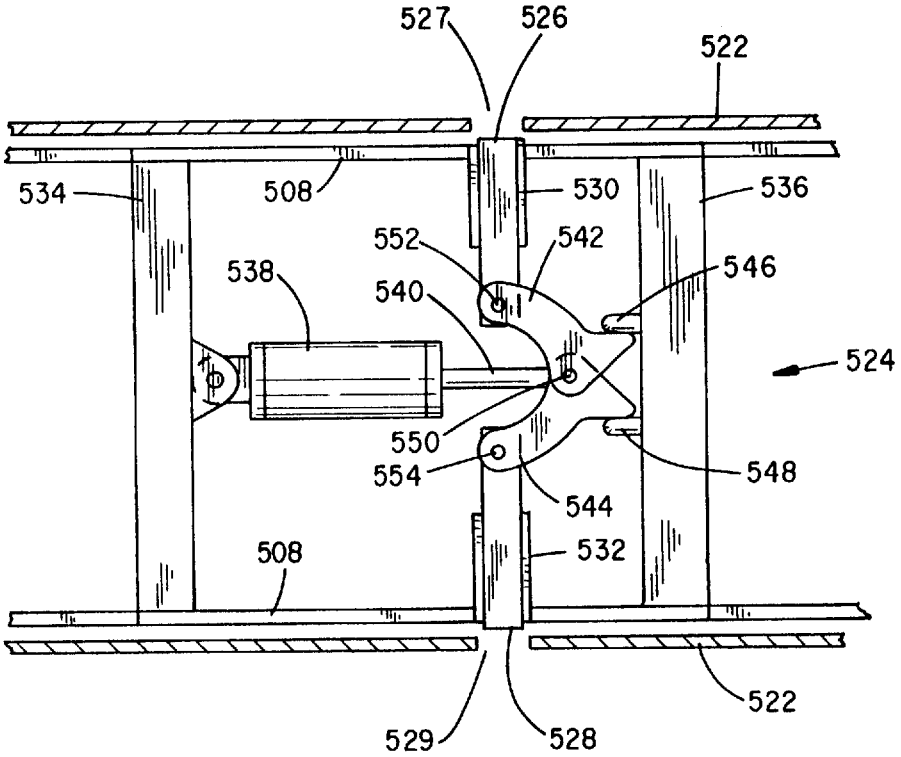

As seen in FIGS. 29–31, the removable storage body 506 is attached to longitudinal frame members or support members 522 which are releasably latched to the subframe 508 by a locking system, indicated generally by the numeral 524. The longitudinal frame members 522 are built to accommodate large latch pins 526 and 528 which ride in guide tubes 530 and 532, respectively, which, in turn, are carried by the subframe 508. Parallel transverse members 534 and 536 are attached to the subframe 508 on each side for support. The transverse structural member 534 carries and supports a double acting, fluid-operated cylinder 538 which, in turn, with rod 540, operates a pair of centrally-connected, pivotally mounted connecting links 542 and 544 which cooperate in a scissor linkage in conjunction with a pair of guide rods 546 and 548 to extend and withdraw the latch pins 526 and 528 along guide tubes 530 and 532. In the fully unlocked position, the projections of the connecting links 542 and 544 are nested between the guide rods 546 and 548 and the piston rod 540 of the cylinder 538 is fully extended.

When the body locking mechanism is actuated to lock a body or container on the subframe, the cylinder 538 is actuated to withdraw the piston rod 540. The projections on the connecting links act to center the latch pin systems so that both latch pins withdraw the same distance. As the rod 540 is withdrawn, the pivot point 550 is advanced toward the cylinder 538. As shown in FIG. 30, when the locking pins 526 and 528 are in the fully extended position, extending through the openings 527 and 529 and fully locking the subframe 508 and body 506 together, the pivot point 550 has been withdrawn to a point beyond the centerline between the pivotal connections 552 and 554 between the locking pins 526 and 528 and the connecting links 542 and 544 so that the pivot point 550 itself is in an over-center lock position such that thereafter inward forces acting on the locking pins 526 and 528 cannot cause the cylinder 538 to extend to an unlocked position. The subframe 508 includes two locking systems 524 attached thereto in spaced relation for holding the body 506 on the subframe 508.

Figure 32:
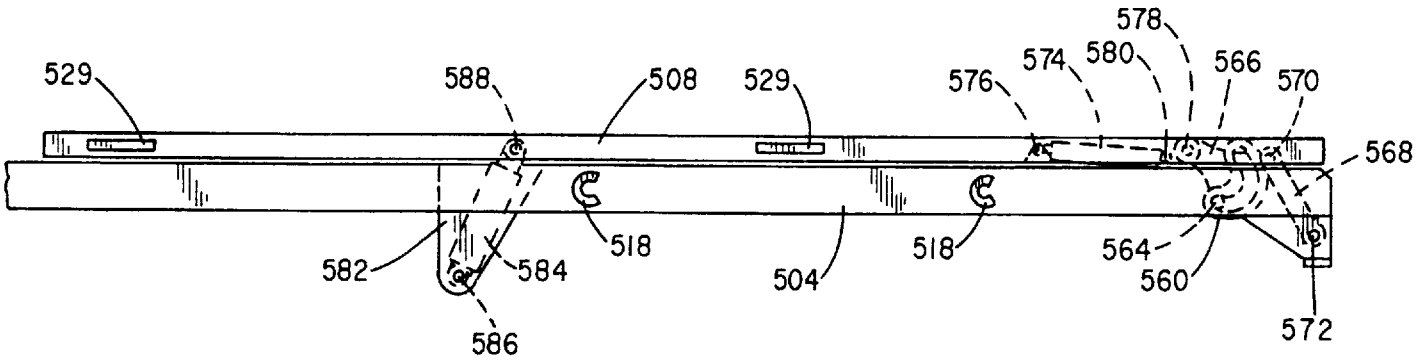
FIGS. 32–34 depict greatly enlarged, partial side views illustrating the mechanical operation of a mechanized subframe and chassis frame assembly associated with a removable body.
Figure 33:
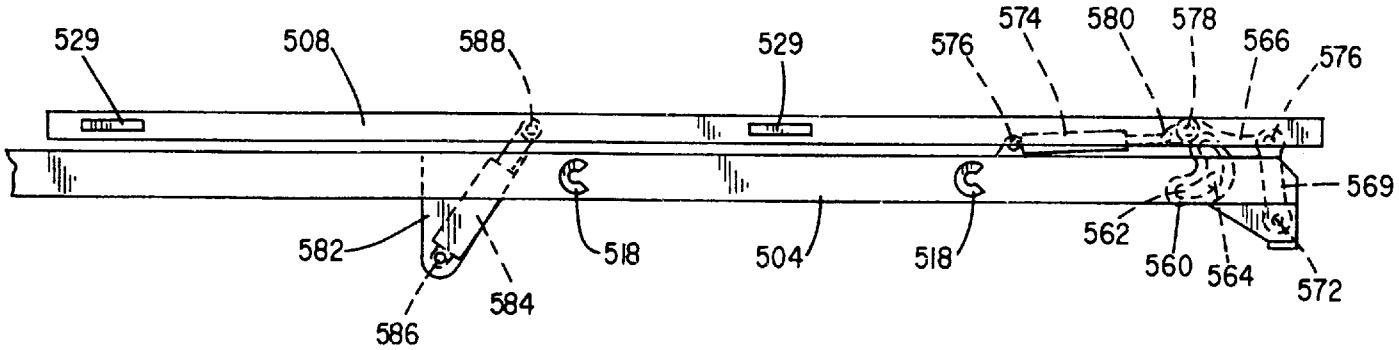
Figure 34:
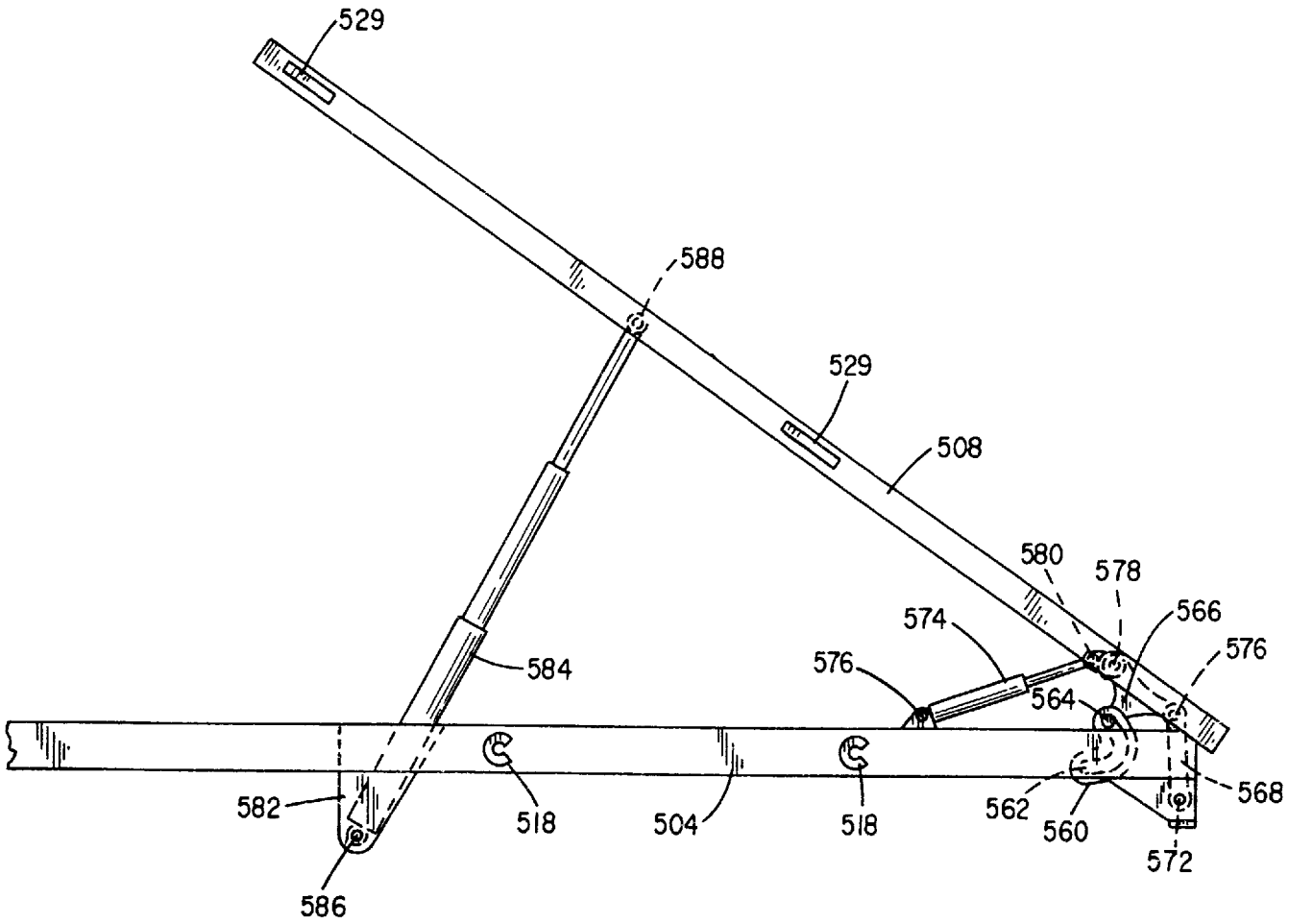

As shown in FIGS. 32–34, the subframe 508 is slidably and pivotally attached to the chassis frame 504 such that the subframe 508 and body 506 are first moved rearward to unlatch pins 516 from hooks 518 before tilting or removing the removable body 506 from the subframe 508. A cam plate 560 having an arcuate slot 562 is fixed to the chassis frame 504 at the rear of the vehicle 500. A cam roller or follower 564 is rotatably attached to a side frame link 566 and disposed to ride in the arcuate slot 562. The subframe link 566, which is basically triangular in shape, is commonly pivotally attached at a second corner with a base link 568 on pivot pin 570. The base link 568 is also pivotally attached to the chassis frame 504 at pivot 572. Fluid (hydraulic) cylinder 574 is pivotally attached to the chassis frame 504 at 576 and to the third corner of the subframe 566 at 578 through a connecting link 580. The subframe link 566 is pivotally attached to the subframe 508 at the third corner pivotal connection 578. Toward the front of the vehicle 500, a gusset member 582 is attached to chassis frame 504 and a hydraulic cylinder 584 is pivotally connected to the gusset member 582 at 586 and to the subframe 508 at 588.

In operation, the body 506 and pins 516 are unlatched from the hooks 518 by extending hydraulic cylinders 574 and 584 in unison to maintain the storage body 506 at a level position. Extending hydraulic cylinder 574 pushes the subframe 508 rearward and moves the roller 564 rearward in the arcuate slot 562 of the cam 560. This unlatches the pins 516 from the hooks 518. Extending the hydraulic cylinder 574 in unison with the hydraulic cylinder 584 causes the roller 564 to follow the arcuate path of the slot 562 such that the subframe 508 begins to raise (FIG. 33). Extending hydraulic cylinders 574 and 584 further, pushes the roller 564 to the top of the arcuate slot 562 and pivots the subframe 508 about subframe pivot joint 578 to a raised or unloading position (FIG. 34). The pivot joints 578 and 570 include cross members which are connected to a corresponding subframe link and base link on the other side of the vehicle 500. This adds stability to the subframe 508 and chassis frame 504 unlatching and tilting assembly.

In the position as shown in FIG. 33, the storage body 506 and pins 516 are unlatched from the hooks 518. Storage body 506 is also raised above the chassis frame 504 such that supports may be put under the storage body 506 and the locking system 524 operated to unlatch the body 506 from the subframe 508. The subframe 508 is then lowered away from the body 506 to the chassis frame 504 and the refuse vehicle 500 may be driven away from the detached or removed storage body 506. In this manner, storage bodies, such as 506, may be removed and replaced at will.

Figure 35:
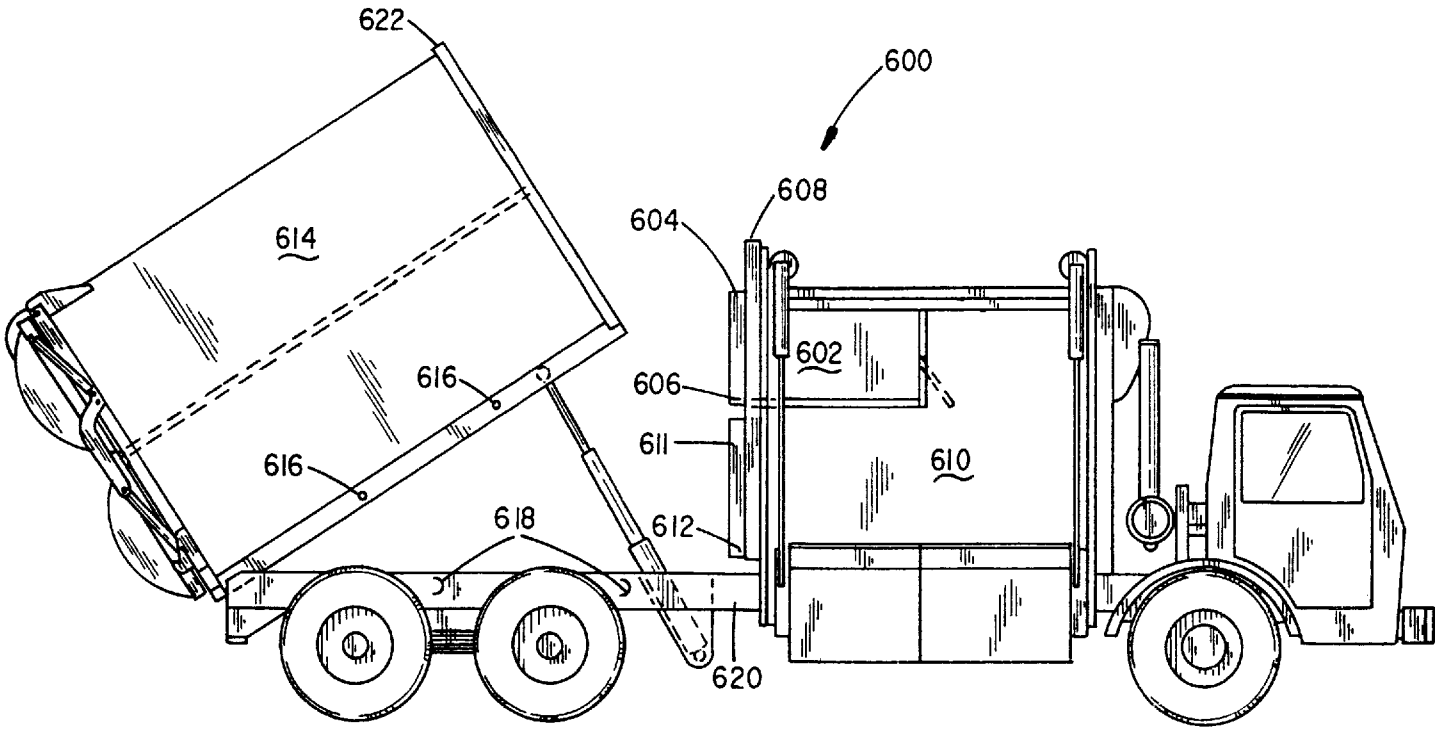
FIG. 35 is a side view of a multiple compartment side-loading refuse vehicle including a detachable or removable body in a tilted posture.

In FIG. 35, the removable body concept is used for a multiple compartment truck body on a vehicle 600. The upper or top charging hopper 602 includes hopper wall 604 and a hopper floor 606 which extends through the rear hopper wall 608. Similarly, the lower charging hopper 610 includes lower hopper wall 611 and a floor 612 which extends through the rear hopper wall 608. The storage body 614 is moveable between a latched position and an unlatched position, such as that shown in FIG. 35. In the latched position, pins 616 which are attached to the storage body 614 interconnect or latch with hook 618 secured to the chassis frame 620. In this position, the storage body 614 is moved forward and the storage body front wall 622 fits closely to the hopper rear wall 608. The upper and lower hopper walls 604 and 611 and the upper and lower hopper floors 606 and 612 extend through the storage body front wall 622 and into the storage body 614 through holes in the storage body front wall 622. The hopper floors 606 and 612 are raised above the floors of the storage body 614 such that a lip is formed by the storage body front wall 622 to prevent liquids from flowing out of the storage body 614. In all other respects, the removable body and subframe assembly, including the locking system for locking the body on the subframe and the unlatching and tilting system for the subframe and chassis frame are the same as those described for the vehicle 500 of FIG. 28. Further details and other removable body systems usable with the invention are described and shown in U.S. patent application Ser. No. 08/377,146, filed Jan. 23, 1995, now abandoned by Garwin B. McNeilus and Ronald E. Christenson, and U.S. patent application Ser. No. 08/398,954, filed Mar. 2, 1995, now U.S. Pat. No. 5,562,390 by Ronald E. Christenson, which is a continuation-in-part of the 08/377,146 application, both of which are hereby incorporated by reference in their entirety for any necessary purposes.

It will be appreciated, for example, that other combinations and permutations of the embodiments shown may be combined to form vehicles having multiple automated arms wherein one automated arm is on each side of the refuse vehicle and any number of compartments in a multiple compartment vehicle may be provided.

Another embodiment of the present invention involves a three compartment refuse vehicle. As shown in FIGS. 36–39, the vehicle, generally 700, includes a truck body 701 having an upper storage compartment 702, middle storage compartment 703, and lower storage compartment 704 divided vertically by horizontal dividing panels or upper compartment floor panels 705 and 706, respectively. The refuse vehicle 700 includes a charging hopper portion indicated generally by 708 with a conventional openable top for charging material along its length. The charging hopper 708 is recessed and has a fully accessible top such as those previously discussed, including, for example, hopper 208 in FIGS. 9–13. Of course, the hopper 708 may be integral with the truck body 701 or the two may be fabricated as separately with the body 701 removable similar to that shown in FIG. 35. In any event, when the body and the hopper are in place, material deposited in each of the charging hopper compartments is accessed, moved, and packed into the storage compartment of the body 701 using a packing ram system.

The charging hopper 708 is subdivided into three compartments or chambers, an upper compartment 710, a middle compartment 712 and a lower refuse receiving compartment 714. The upper refuse hopper compartment 710 is defined or separated by a "L"-shaped partition system including a horizontal dividing member or floor panel member 705 which may be a continuation of the floor member 705 in the storage compartment 702 or an abutting like member in the case of a separated charging hopper which mates to a shaped vertical upper dividing wall 716 which, with the floor 705, defines the upper or rear receiving hopper compartment or chamber 710. Likewise, a further horizontal dividing panel 706 together with the vertical hopper dividing wall 718 define the intermediate charging hopper chamber 712 and the remaining charging hopper chamber 714. Each of the charging hopper compartments 710, 712 and 714 are open rearward adjoining respective corresponding truck body storage compartment 702, 703 and 704. The storage compartments 702, 703 and 704 are provided with individual tailgates 720, 722 and 724, respectively. As indicated for the above two compartment system of FIGS. 9–13, this enables separate processing of three types of refuse, if desired.

Loading is accomplished by utilizing a divided loading bin or bucket 726 which is partitioned into corresponding bin compartments 228, 230 and 232. The bucket 726 is mounted and operated, e.g., raised from a lowered position (FIGS. 36 and 38) to a discharge position in the manner of the embodiment of FIGS. 3 and 11 whereby refuse contained in the loading bin compartments are dumped into corresponding aligned charging hopper compartments. The mechanization is as has been previously described in relation to other embodiments utilizing the candy-cane shaped guide channels and follower rollers in the mechanized lift and dump system.

Figure 36:
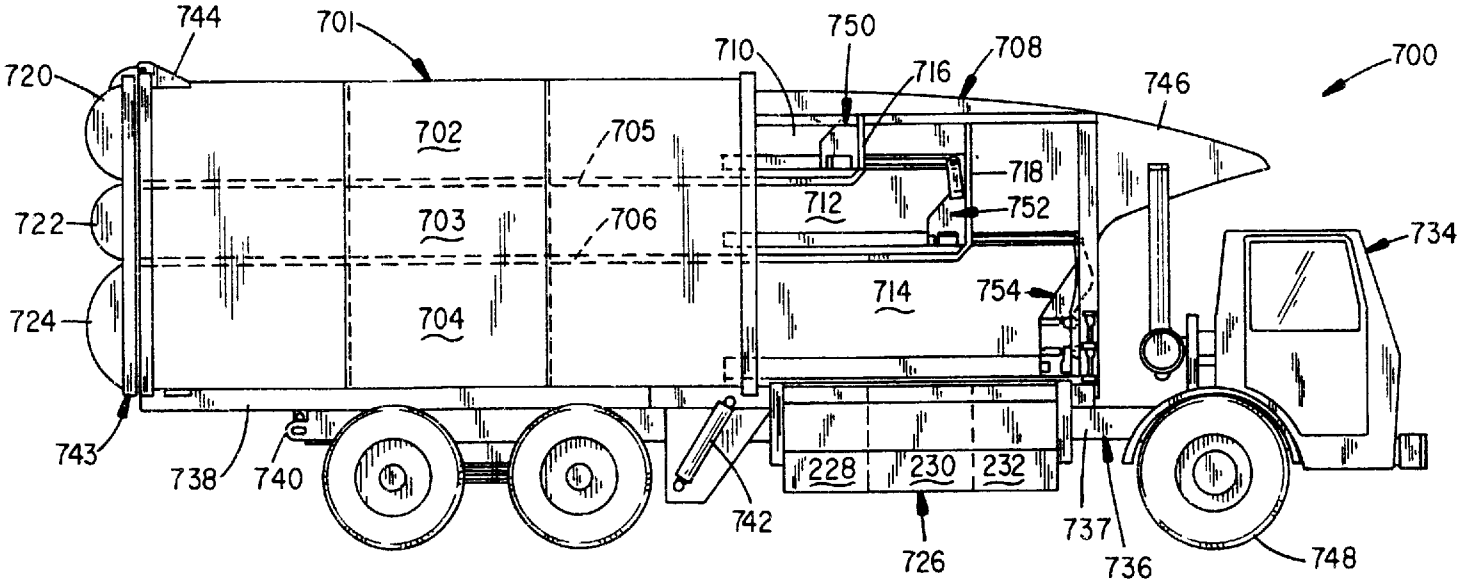
FIG. 36 is a side elevational view of a three compartment side-loading refuse vehicle in accordance with the invention.
Figure 38:
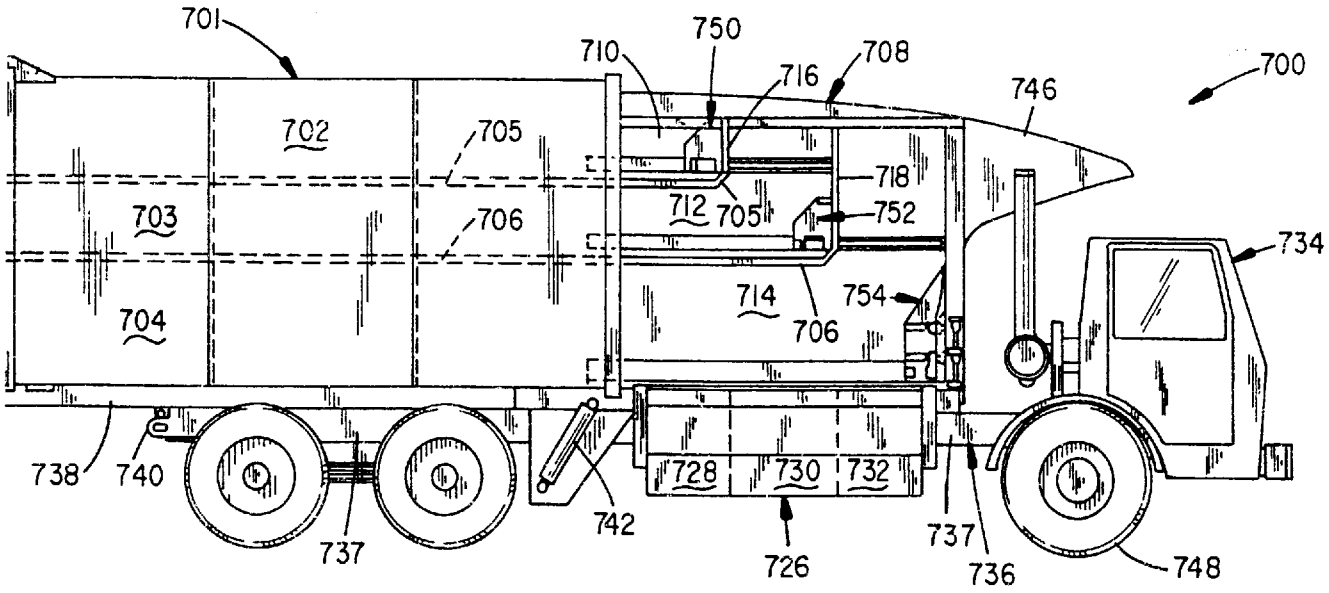
FIGS. 38 and 39 are views similar to those of FIGS. 36 and 37, illustrating an independent ram compacting arrangement for a three-compartment system.

As depicted in FIGS. 36 and 38, the multiple compartment refuse vehicle 700 is otherwise conventional with a cab 734 connected to a chassis frame 736 including channels 737 which carries the truck body and charging hopper combination. The truck body 701 may be carried on a sub-frame 738 pivotally mounted at 740 and operated by tilt cylinders as at 742 to provide a dumping function in a well known manner. Of course, the truck body may be removable in the manner of the embodiments previously described and such feature will be understood with reference to this embodiment. The tailgates are also hinged for separate opening or may be opened as a unit having a frame 743 mounted from top hinge systems as at 744 to swing open as has been described. The truck further includes cab protector 746 and conventional refuse truck wheels as at 748.

Figure 37:
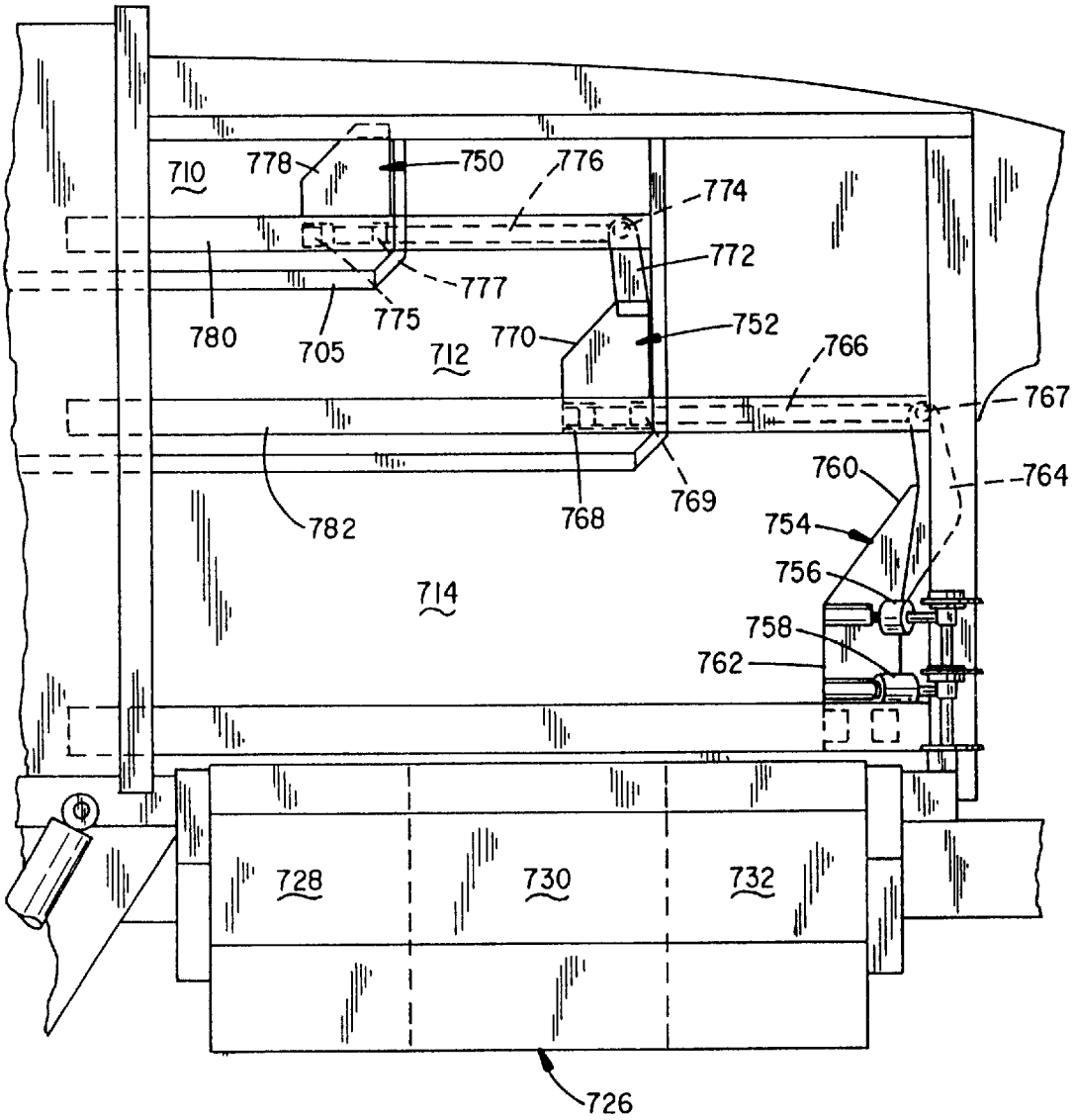
FIG. 37 is an enlarged fragmentary view of the charging hopper of the side-loading refuse vehicle of FIG. 36 showing the compacting arrangement details.

As can be seen in FIG. 36, and better seen in the enlarged view of FIG. 37, the three charging hopper chambers or compartments are provided with packing ram systems, generally, respectively 750, 752 and 754. The operation of the systems 750 and 752 derives from a linkage system connected with cylinder-powered ram system 754. In this manner, ram system 754 is operated by a pair of linear actuators 756 and 758 which operate beneath an expanding projecting protective cover 760 to operate a packing panel 762 horizontally in a well known manner. The packing ram system 754 also includes one or more linkage lever members as at 764, the lower portion of which is connected to the ram system 754. The upper end is attached to compliant linkage or connecting rod member 766 at 767 and moves reciprocally with the packing blade 762. The linkage member 766 is also attached to panel 770 of packing ram system 752 at 768 and 769. The ram system 752 also carries one or more link members as at 772 connected at 774 to a further compliant linkage rod 776 which in turn is connected to the ram system 750 at 775 and 777 to operate a packer blade 778 of the packing ram system 750 of receiving hopper chamber 710.

In this manner, one set of hydraulic cylinders such as shown at 756 and 758 can operate all three compactors through the linkage system and simultaneously address refuse in all three charging hopper chambers, moving it and compacting it into the adjacent storage compartments. The ram systems 750 and 752 may further be provided with force modulating means to moderate the force applied by either packer system 750 or 752, if desired, such a system is illustrated and described in co-pending application Ser. No. 08/389,087, filed Feb. 15, 1995, entitled "MULTIPLE COMPARTMENT BODY FOR WASTE MATERIALS", now abandoned. The disclosure of that application is hereby deemed incorporated by reference for any necessary purpose.

The ram system 750 is provided with support or guide rails as at 780 which support and guide the reciprocating packing ram system 750 as it is operated by the compliant linkage member 776 and linkage lever 772. Likewise, the ram system 752 rides in guide rails 782 as operated by middle packer compliant linkage member 766 operated by linkage lever 764. In this manner, after divided loading bucket 726 is dumped into the divided multi-compartment hopper 708, the linkage system operated by the hydraulic cylinders 756 and 758 causes all three packer panels to operate in unison moving the refuse into each of the connected storage compartments of the storage body 701.

Figure 39:
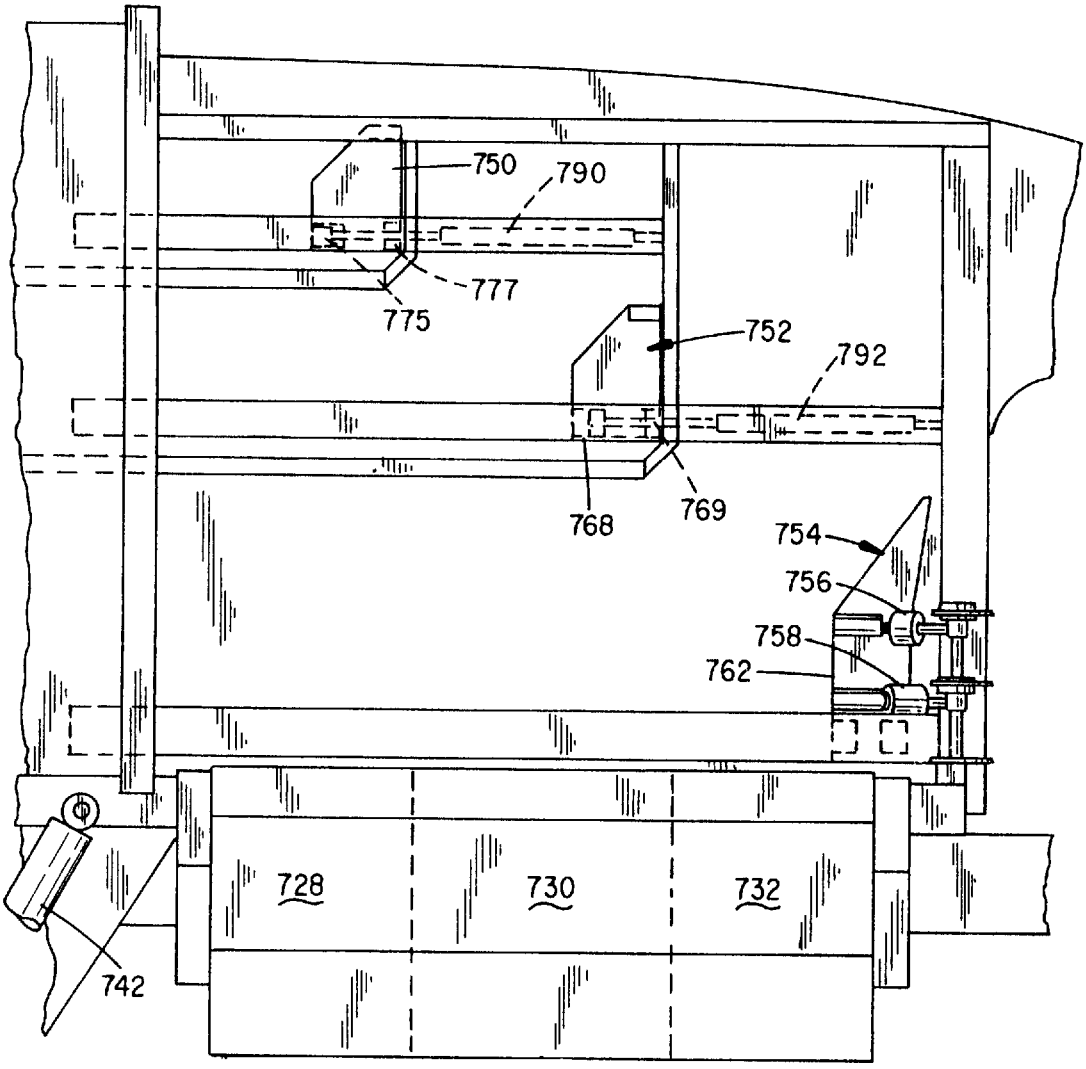

The embodiment depicted in FIGS. 38 and 39 is similar to that of FIGS. 36 and 37, with the exception that the packer systems are independently operable and the compliant linkage system removed. Thus, the packer system 750 is provided with its own ram-operating hydraulic cylinders as at 790 with the rod end connected at 775 and 777 in place of the compliant rod 776 and, likewise, the packer panel system 752 is independently operated by a plurality of hydraulic cylinders, one of which is shown at 792. Typically these are a pair of double-acting hydraulic cylinders which operate to move each packer panel fore and aft in conjunction with the packing of refuse into a particular connected storage compartment of the refuse truck body 701.

This invention has been described herein in considerable detail in order to comply with the patent statutes and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A multi-compartment apparatus for collecting refuse comprising:

(a) a truck body having a forward end and an aft end and a maximum width mountable to a truck frame and extending longitudinally therealong and enclosing a multi-compartment material receiving and storage volume;

(b) an offset multi-compartment charging hopper mountable to the truck frame forward of said truck body and adapted to receive material from a multi-compartment loading bucket and charge material into said material receiving and storage volume, each charging hopper compartment being aligned to charge material into a corresponding material receiving and storage compartment, and wherein at least one side of said charging hopper is an offset side recessed a sufficient amount to accommodate the full width of a juxtaposed loading bucket within the maximum width of said truck body, said loading bucket being generally vertically operable along said offset side;

(c) a loading bucket carried by said charging hopper and having an extended inner wall and an outer wall flanked by a pair of end walls, and the bucket describing a like number of loading compartments for receiving refuse material, said extended inner wall extending above the level of said outer wall, and said loading bucket being generally vertically moveable along an initially outward extending path along said offset side of said charging hopper between a lowered position and a raised, at least partially inverted, discharge position;

(d) wherein said path along which said bucket moves is fixed relative to said loading hopper and includes a pair of spaced forward and aft shaped elongated recesses having lower segments that are outwardly directed each adapted to receive a pair of upper and lower follower members generally vertically spaced with respect to said bucket and being attached to a corresponding forward or aft wall of said bucket, said followers being slightly offset, the upper follower being outside the lower follower such that in cooperation with the outward directed lower segments of said recesses said bucket is initially vertical but tilts toward said offset side of said charging hopper when said followers are in a vertical path, said path further including an arcuate upper dumping portion and wherein said offset followers cooperate to increase the degree of inversion of said bucket at a fully up or discharging position;

(e) an operable charging hopper lid pivotally attached to said charging hopper and linear operating means for pivoting said charging hopper lid, said charging hopper lid being connected to said loading bucket in a manner such that operation of said charging hopper lid operates said loading bucket; and (f) wherein each of said charging hopper compartment further comprises linear operating compaction mechanism for charging material deposited therein into a corresponding compartment of said receiving and storage volume.

2. The apparatus of claim 1 wherein said bucket includes three longitudinally consecutive compartments.

3. The apparatus of claim 1 wherein each said compaction mechanism comprises an independent compacting ram means.

4. The apparatus of claim 3 wherein said loading compartment of said bucket and said charging hopper compartments are longitudinally consecutive, said charging hopper compartments and said material receiving and storage compartments further being vertically consecutive.

5. The apparatus of claim 3 wherein said loading bucket includes three compartments.

6. The apparatus of claim 1 wherein a single powered packing ram system associated with one of said charging hopper compartments operates all of the compaction mechanisms.

7. The apparatus of claim 6 wherein said loading compartment of said bucket and said charging hopper compartments are longitudinally consecutive, said charging hopper compartments and said material receiving and storage compartments further being vertically consecutive.

8. The apparatus of claim 6 wherein said loading bucket includes three compartments.

9. The apparatus of claim 6 further comprising linkage means connecting said single powered packing ram system to auxiliary compaction mechanisms associated with said other compartments.

10. The apparatus of claim 1 wherein said loading compartment of said bucket and said charging hopper compartments are longitudinally consecutive, said charging hopper compartments and said material receiving and storage compartments further being vertically consecutive.

11. The apparatus of claim 1 wherein said truck body is detachable.

12. The apparatus of claim 11 including a sub-frame between said truck body and said truck frame.

13. The apparatus of claim 1 wherein said charging hopper lid and said loading bucket are connected by mechanical linkage.

* * * * *